US008863426B1

(12) United States Patent
Zinsner

(10) Patent No.: US 8,863,426 B1
(45) Date of Patent: Oct. 21, 2014

(54) QUICK-RELEASE HAND GUARD ASSEMBLY FOR A RIFLE

(71) Applicant: Brendon B. Zinsner, Sarasota, FL (US)

(72) Inventor: Brendon B. Zinsner, Sarasota, FL (US)

( * ) Notice: Subject to any disclaimer, the term of this patent is extended or adjusted under 35 U.S.C. 154(b) by 80 days.

(21) Appl. No.: 13/755,714

(22) Filed: Jan. 31, 2013

(51) Int. Cl.
*F41C 23/16* (2006.01)

(52) U.S. Cl.
CPC ..... *F41C 23/16* (2013.01)
USPC ..... 42/71.01; 42/72; 42/75.01; 42/75.02; 42/75.03

(58) Field of Classification Search
USPC ..... 42/71.01, 72, 75.01, 75.02, 75.03, 85
See application file for complete search history.

(56) References Cited

U.S. PATENT DOCUMENTS

| | | | | |
|---|---|---|---|---|
| 5,590,484 | A * | 1/1997 | Mooney et al. | 42/111 |
| 6,499,245 | B1 * | 12/2002 | Swan | 42/71.01 |
| 6,671,990 | B1 * | 1/2004 | Booth | 42/75.01 |
| 6,895,708 | B2 * | 5/2005 | Kim et al. | 42/72 |
| 6,959,509 | B2 * | 11/2005 | Vais | 42/75.02 |
| 7,216,451 | B1 * | 5/2007 | Troy | 42/72 |
| 8,276,304 | B2 * | 10/2012 | Samson et al. | 42/75.02 |
| 8,359,779 | B2 * | 1/2013 | Daniel et al. | 42/75.03 |
| 8,607,490 | B1 * | 12/2013 | Zinsner | 42/71.01 |
| 8,726,559 | B1 * | 5/2014 | Mueller | 42/75.02 |
| 8,739,448 | B2 * | 6/2014 | Kimmel et al. | 42/71.01 |
| 2004/0049964 | A1 * | 3/2004 | Vais | 42/75.02 |
| 2011/0061281 | A1 * | 3/2011 | Kapusta et al. | 42/71.01 |
| 2011/0239513 | A1 * | 10/2011 | Sandman | 42/90 |
| 2012/0297970 | A1 * | 11/2012 | Langevin et al. | 89/125 |
| 2014/0026459 | A1 * | 1/2014 | Yan et al. | 42/71.01 |

* cited by examiner

*Primary Examiner* — Bret Hayes
*Assistant Examiner* — Derrick Morgan
(74) *Attorney, Agent, or Firm* — Dorothy S. Morse

(57) ABSTRACT

A quick-detach, free floating, two-piece forward hand guard assembly for a rifle, which includes an inner barrel nut adapted for connection to the rifle's receiver and an outer barrel nut telescopically received over the inner barrel nut and secured thereto to prevent rotation therebetween. The hand guard assembly also includes a top hand guard element engaged with and extending forwardly from the outer barrel nut in a laterally-stable cantilevered orientation above the rifle's barrel. A bottom hand guard element is matingly engaged with the top hand guard element for surrounding the bottom portion of the rifle's barrel and free-floats from the top hand guard element. A spring-loaded detent screw attaches the top and bottom hand guard elements together and also engages the inner barrel nut. For quick-detach barrel removal, the outer barrel nut may be hinged for clamshell action, with the inner barrel nut having a separable two-piece extension.

20 Claims, 18 Drawing Sheets

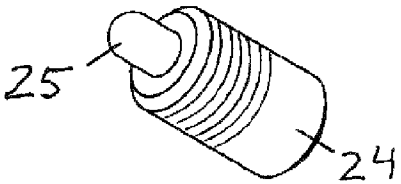
FIG. 12
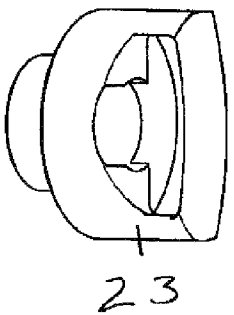
FIG. 14
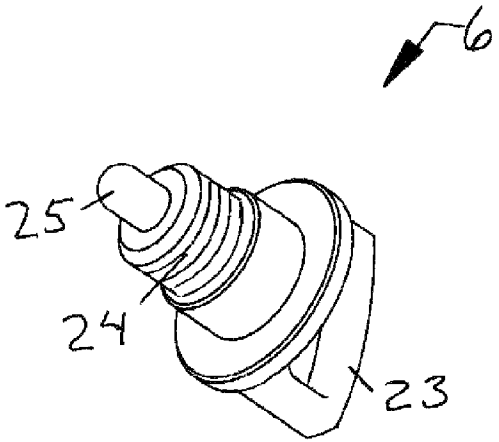
FIG. 11
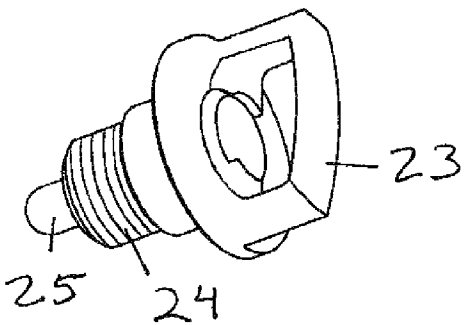
FIG. 13
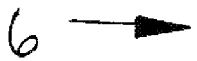

QUICK-RELEASE HAND GUARD ASSEMBLY FOR A RIFLE

CROSS-REFERENCES TO RELATED APPLICATIONS

This application is a Continuation-In-Part of a currently pending U.S. utility patent application for similar subject matter, which has the application Ser. No. 13/106,357, a Filing Date of May 12, 2011, and the Title of 'Quick Release Hand Guard Assembly for a Rifle'. U.S. utility patent application Ser. No. 13/106,357 was filed by Kennneth F. Lupson, a business partner of the actual inventor and applicant herein, Brendon B. Zinsnser. Kennneth F. Lupson was the President of the jointly owned business and through a misunderstanding he hired attorneys to file U.S. utility patent application Ser. No. 13/106,357 in his own name, not in the name of the actual inventor, Brendon B. Zinsnser. A Request to Correct Inventorship under 37 CFR 1.48(a) was filed on Oct. 31, 2012, and in part included the following statement by Brendon B. Zinsner: "I am the actual inventor of the Quick Release Hand Guard Assembly for a Rifle that is disclosed in the above-identified pending U.S. patent application Ser. No. 13/106,357. I operated a Florida corporation with three other people, including Kenneth F. Lupson who is its President. Due to a misunderstanding at the time of filing U.S. patent application Ser. No. 13/106,357, Kenneth F. Lupson was named as the sole inventor as a result of his status as President of the corporation. This error occurred without deceptive intent on my part, and now since I recognize that an error has been made, I want to see it corrected." As a result of the above, the applicant herein respectfully requests domestic priority for this patent application based upon the currently pending U.S. utility patent application Ser. No. 13/106,357, which by now is expected to have the name of Brendon B. Zinsner substituted as the actual inventor.

BACKGROUND

1. Field of the Invention

The present invention generally relates to hand guards for rifles, and more particularly to a quick-detach and free-floating forward hand guard assembly for a rifle that has no contact with the rifle's barrel and comprises a two-piece quad rail hand guard structure, including a top hand guard element engaged with, and extending forwardly from, an outer barrel nut in a laterally-stable cantilevered orientation, and also including a bottom hand guard element locked with the top hand guard element to remain free-floating therefrom. The top hand guard element slides over, and is solely supported by, the outer barrel nut, which is telescopically received over an inner barrel nut having fixed connection to a portion of the rifle's upper receiver, thus allowing the rifle's barrel (which also has an independent fixed connection to the rifle's receiver) to extend through the generally tubular inner barrel nut without any contact therewith. The outer barrel nut is longitudinally secured to the inner barrel nut with set screws to provide a fixed/non-rotational connection between them, which in combination with top/bottom stabilizing structure on the outer barrel nut that engages interior hand guard structure, prevents up-and-down or side-to-side hand guard movement and allows the cantilevered two-piece present invention hand guard to hold tight and true during use. The present invention further comprises plurality of venting holes through the top and bottom hand guard elements and an aluminum outer barrel nut configured with baffles for heat dissipation, with one embodiment that allows quick-detach barrel removal comprising a hinged outer barrel nut with clamshell action and an inner barrel nut with a two-piece separable extension that easily splits in two for quick removal while allowing its adjacent ring-shaped receiver end to remain secured to the upper receiver portion of the rifle. To achieve quick and easy installation, the top hand guard element has two upper female recesses in opposed positions that during installation allow it to slide on and around raised lugs on the left and right sides of the outer barrel nut with a downward push. Additional lower recesses about midway on the bottom hand guard element are configured to allow raised lugs on each side of the upper recesses to slide into them, and pushing the bottom hand guard element in an upward direction then allows it to slide in a backward motion that locks it to the top hand guard element and against the outer barrel nut approximately one inch forward of the back half of the outer barrel nut. A spring-loaded detent screw engaged with one sling swivel recess (having a rotation limiter and threads) that is located on the receiver end of the top hand guard element tightly secures the top and bottom hand guard elements together, and at the same time puts pressure on both sides of the present invention hand guard due to the fact that the tip of the spring detent is against the inner barrel nut pushing away from the opposite side of the barrel nut. What sets the present invention hand guard apart from all others is structure allowing unique assembly and disassembly, and the first 2.25-inches of the end closest to the receiver is where most of the mechanics take place. In addition, distinguishable structure in the present invention hand guard provides advantages during use in extreme environmental conditions, including desert, snow, and salt water, to aid heat dissipation generated during weapon operation and prevent shifts in barrel alignment over time that could adversely affect weapon accuracy.

2. Description of the Related Art

Gunstocks for handheld weapons date back to the sixteenth century and at that time typically comprised a simple stick fitted into a socket in the breech end of the weapon to provide a handle for the user. Over the following centuries, gunstocks typically remained fashioned from wood. Initially, gunstocks were one piece from butt to fore end, but certain weapon configurations lent themselves to two-piece stocks where the fore end was separate from the butt and grip.

The evolution of the rifle, and especially with respect to the genre of weapons categorized as assault rifles or assault weapons mass-produced for arming a country's military forces, has resulted in the use of gunstock hand guards that are separate from the remaining stock members, which facilitates cleaning. Furthermore, while traditional gunstocks have been machined from wooden blanks, today's gunstocks are typically formed of metal, injection molded thermoplastic, or a combination of the two.

Use of a separate gunstock hand guard is now common and fulfills multiple functions. The primary purpose of the hand guard is to insulate the shooter's hand from the heat of the rifle barrel. Secondly, the hand guard can include provisions (such as groove sets on one or more of its sides commonly referred to as a rail) for mounting accessories to the weapon such as, for example, a flashlight aligned with the barrel to illuminate the area in front of the weapon in low light or dark lighting conditions. On early rifles, accessory mounting provisions were almost exclusively employed for mounting telescopic sights and were thus provided mainly on the top portion of the rifle's receiver. However, for militarized assault rifles such as the M16, accessory mounting provisions are found on the hand guard (commonly known as Picatinny rails since they were developed at the Picatinny Arsenal), with one or more Picatinny rails usually found on each hand guard. Picatinny rails are standardized in structure, with dimensional specifications found in MIL-STD-1913 or ST ANAG 2324. As used herein, the term "quad rail" denotes four Picatinny rails placed equal lengths apart on a cylinder type hand guard. Hand guards may be either permanently mounted to the weapon or employ a "quick attach/detach" design that allows quick separation into two halves.

In prior art rifles, the barrel rests in contact with the stock and in particular with the fore end (or hand guard portion) of the stock. If the stock is manufactured of wood, environmental conditions or operational use may shift the alignment of the stock, which, in turn, may cause the attached barrel to slightly shift its alignment over time. This alignment shift can significantly alter the flight path of the projectile, and thus its impact point. Contact between the barrel and the stock also interferes with the natural frequency of the barrel, which, in some cases, can be detrimental on the weapon's accuracy. The interference of the stock with the barrel's forced oscillation as the projectile passes down the bore can cause the barrel to vibrate inconsistently from shot to shot, depending on differing external forces acting upon the stock at the time of the shot. Micro-vibrations acting during the projectile's passage through the barrel can result in unexpected trajectory differences as the projectile exits its bore, thus changing the downrange impact point.

One prior art method of minimizing this detrimental interference between the hand guard and the barrel has been to free-float the barrel with respect to the hand guard. Specifically, the barrel and the hand guard are each independently affixed to the weapon's receiver and project forward from the receiver in cantilevered fashion. The barrel and stock are designed to not touch at any point along the barrel's length. Thus, the barrel is "free-floating" and does not contact other gun parts, other than the weapon's front sight, which minimizes mechanical pressure distortions potentially affecting barrel alignment and further allows vibration to occur at the barrel's natural frequency. Free-floating hand guards have also been used. However, to maintain stability of the prior art free-floating hand guard, its attachment has typically been permanent, or comprised a one-piece quick-attach design to prevent the lateral shifting of hand guard elements with respect to each other that could otherwise be expected to occur in multiple-piece hand guards and potentially lead to weapon inaccuracy.

Another disadvantage of single piece hand guards is that, even if quickly detachable, they typically also require the highly undesirable removal of the front sight from the barrel in order to facilitate total removal of the hand guard for weapon cleaning. Conversely, quickly detachable hand guards comprising a multiple-piece (usually two pieces) design are not free-floating and instead are typically attached to the front end of the barrel. The inventor herein previously developed a two-piece hand guard having internal male ribs that went into female slots on the outer barrel nut (which is disclosed in U.S. patent application Ser. No. 13/106,357). The top hand guard element was installed in a downward push straight onto the outer barrel nut, and the bottom hand guard element was installed the same way only in the upward push direction. Latches were then used to secure the top and bottom hand guard elements together. Although these features allowed easy assembly, certain features made it too costly to manufacture. In contrast, the present invention hand guard disclosed herein has top and bottom hand guard elements without internal features that are costly to manufacture. In addition, the outer barrel nut structure in the present invention has no female rib features, instead having raised lugs on its left and right sides that allow the top hand guard element to slide on the outer barrel nut with the same downward push that the inventor herein used for the hand guard in his U.S. patent application Ser. No. 13/106,357. The improvement herein prevents a need for latches to connect the top and bottom hand guard elements together during use through use of a spring-loaded detent screw engaged with one sling swivel recess (having a rotation limiter and threads) that is located on the receiver end of the top hand guard element. The detent screw tightly secures the top and bottom hand guard elements together, and at the same time puts pressure on both sides of the present invention hand guard due to the fact that the tip of the spring detent is against the inner barrel nut pushing away from the opposite side of the barrel nut.

From the discussion hereinabove it can be determined that a two-piece and quick-detach quad rail hand guard for rifles is known, but none have structure allowing them to be free-floated. Two-piece and free-floated quad rail hand guards are also known, but none have a quick-detach construction. Furthermore, although one free-floated and quick-detach quad rail hand guard is known, it has a one-piece construction with undesired limitation that when there is an obstruction in front of the hand guard, such as a front sight or gas block, the hand guard cannot come off unless the sight or gas block is removed. The present invention hand guard herein has structure that addresses all four of the desired features in a hand guard. It is quick-detach, free-floated, quad rail, and two-piece, so that its top and bottom hand guard elements can quickly be removed to expose the barrel, yet its structure prevents up-and-down or side-to-side movement thereof during use, allowing the two-piece present invention hand guard to hold tight and true and not cause any adverse interference with weapon accuracy. No other hand guard on market does this, while also allowing quick attachment/detachment without removal of an attached scope or other rifle accessory and providing an option for quick-detach barrel removal when the hinged version of its outer barrel nut is used with the inner barrel nut having a separable two-piece extension.

BRIEF SUMMARY OF THE INVENTION

The primary objective of this invention is to provide a quick-release, free-floating, two-piece forward hand guard assembly for a rifle. It is also an objective of this invention to provide a hand guard assembly that has no contact with the rifle's barrel to prevent possible shifts in barrel alignment and also prevent interference with the natural frequency of the barrel, both of which over time may adversely affect rifle accuracy. An additional objective of this invention is to provide a two-piece hand guard assembly for a rifle with reduced up-and-down and side-to-side movement of hand guard members, allowing it to hold tight and true during use. It is a further objective of this invention to provide a two-piece hand guard assembly for a rifle with structure and design that helps to dissipate heat generated by a projectile passing through the rifle barrel it surrounds. Another objective of this invention is to provide a two-piece hand guard assembly with its pieces tightly secured together without the use of latches. A further objective of this invention is to provide a two-piece hand guard assembly with structure and design that allows for cost-efficient manufacture. Another objective of this invention is to provide a two-piece quick-release hand guard assembly providing a quad rail configuration. It is also an objective of this invention to provide a hand guard assembly that allows quick-detach barrel removal.

A first preferred embodiment of the present invention is a quick-release, free floating, two-piece forward hand guard assembly for a rifle with quad rail construction. Its structure includes an inner barrel nut configured for fixed connection to the front portion of a rifle receiver, an outer barrel nut telescopically received over the inner barrel nut, a top hand guard element mounted on the outer barrel nut and cantilevered from it, a bottom hand guard element that is solely supported by the top hand guard element, and one spring-loaded detent screw engaged with threads on one of the sling swivel recesses (according to whether the user is right-handed or left-handed) on the receiver end of the top hand guard element that tightly secures the top and bottom hand guard elements together, and at the same time puts pressure on both sides of the present invention hand guard due to the fact that the tip of the spring detent is against the inner barrel nut pushing away from the opposite side of the barrel nut. Longitudinal connection of outer barrel nut to inner barrel nut via recesses and set screws helps to prevent side-to-side and front-to-back movement of the top and bottom hand guard elements during their use. The top hand guard element is engaged with, and extends forwardly from, the outer barrel nut in a laterally-stable cantilevered fashion to cover the top portion of the rifle's barrel, and the bottom hand guard element is matingly engaged with the top hand guard element and free-floating from the top hand guard element. Tabs and recesses also help the installation and securing together of the top and bottom hand guard elements. In addition, to prevent side-to-side movement of the top and bottom hand guard elements during use, the outer barrel nut has top and bottom stabilizing projections configured to fit tightly within receiving structure respectively located in the top interior surface of the top hand guard element and the bottom interior surface of the bottom hand guard element. Furthermore, the outer barrel nut is configured as a heat sink, is non-rotatable with respect to the inner barrel nut, and has tabs on each side that slide over a portion of the upper receiver (just under upper receiver Picatinny rails) when the outer barrel nut is fully seated on the inner barrel nut, that assist in the prevention of side-to-side movement of the top and bottom hand guard elements.

A second preferred embodiment of the present invention also has an inner barrel nut, an outer barrel nut, a top hand guard element, a bottom hand guard element, and one spring-loaded detent screw identified above for the first preferred embodiment of the present invention. However, it also has additional structure that allow quick-detach removal of the rifle barrel after the joined top and bottom hand guard elements have been removed, which includes a hinged version of the outer barrel nut that provides a clamshell closing action around the inner barrel nut, and an inner barrel nut having an easily removed two-piece separable extension. The outer barrel nut also has a top split remotely positioned from its hinge that permits its open and closed movement, and aligned holes, one in the top hand guard element and the other in the_outer barrel nut, allow for easy adjustment of the clamshell closing action to provide a proper fit for the outer barrel nut on and around the inner barrel nut. As in the first preferred embodiment of the present invention, one spring-loaded detent screw becomes engaged with one of the sling swivel recesses on the receiver end of the top hand guard element, and when tightened secures the top and bottom hand guard elements together, while at the same time putting pressure on both sides of the present invention hand guard due to the fact that the tip of the spring detent is against the inner barrel nut pushing away from the opposite side of the barrel nut. Also, as in the first preferred embodiment of the present invention, the outer barrel nut in the second preferred embodiment of the present invention hand guard assembly includes rearward-extending tabs that are laterally-spaced one from the other for closely receiving the front portion of the receiver therebetween, and its second end becomes free-floating with respect to the barrel in a laterally-stable cantilevered orientation.

What sets the present invention hand guard apart from all others is structure allowing unique assembly and disassembly, and the first 2¼ inches thereof is where most of the mechanics take place. Furthermore, the inner structure on the top and bottom hand guard elements prevents up-and-down or side-to-side movement relative to the outer barrel nut, allowing the two-piece present invention hand guard to hold tight and true during its use. In addition, use of the present invention hand guard is beneficial in extreme environmental conditions, including desert, snow, and salt water, as its structure and design help to prevent shifts in barrel alignment that over time adversely affect weapon accuracy. No invention is known to have the same structure and advantages of the present invention quick-release, two-piece, free-floating, quad rail hand guard assembly disclosed herein. These and other features, aspects, and advantages of the invention will be further understood and appreciated by those skilled in the art by reference to the following written specification, claims, and appended drawings.

BRIEF DESCRIPTION OF THE SEVERAL VIEWS OF THE DRAWINGS

Several of the most preferred embodiments of the present invention will now be described, by way of example, with reference to the accompanying drawings, wherein like numerals denote like elements throughout the various views of the drawings, and in which:

FIG. 11 is a perspective view of a quick-release spring-loaded detent screw used as a part of the first preferred embodiment of the present invention.

FIG. 12 is a perspective view of the spring plunger portion of the detent screw shown in FIG. 11.

FIG. 13 is a perspective view from the rear of the quick-release spring-loaded detent screw shown in FIG. 11, and showing the easily hand-manipulated thumb screw configuration of its handle portion.

FIG. 14 is a perspective view of the of the handle portion of the spring-loaded detent screw shown in FIGS. 11 and 13.

DETAILED DESCRIPTION OF THE INVENTION

Figure 1:
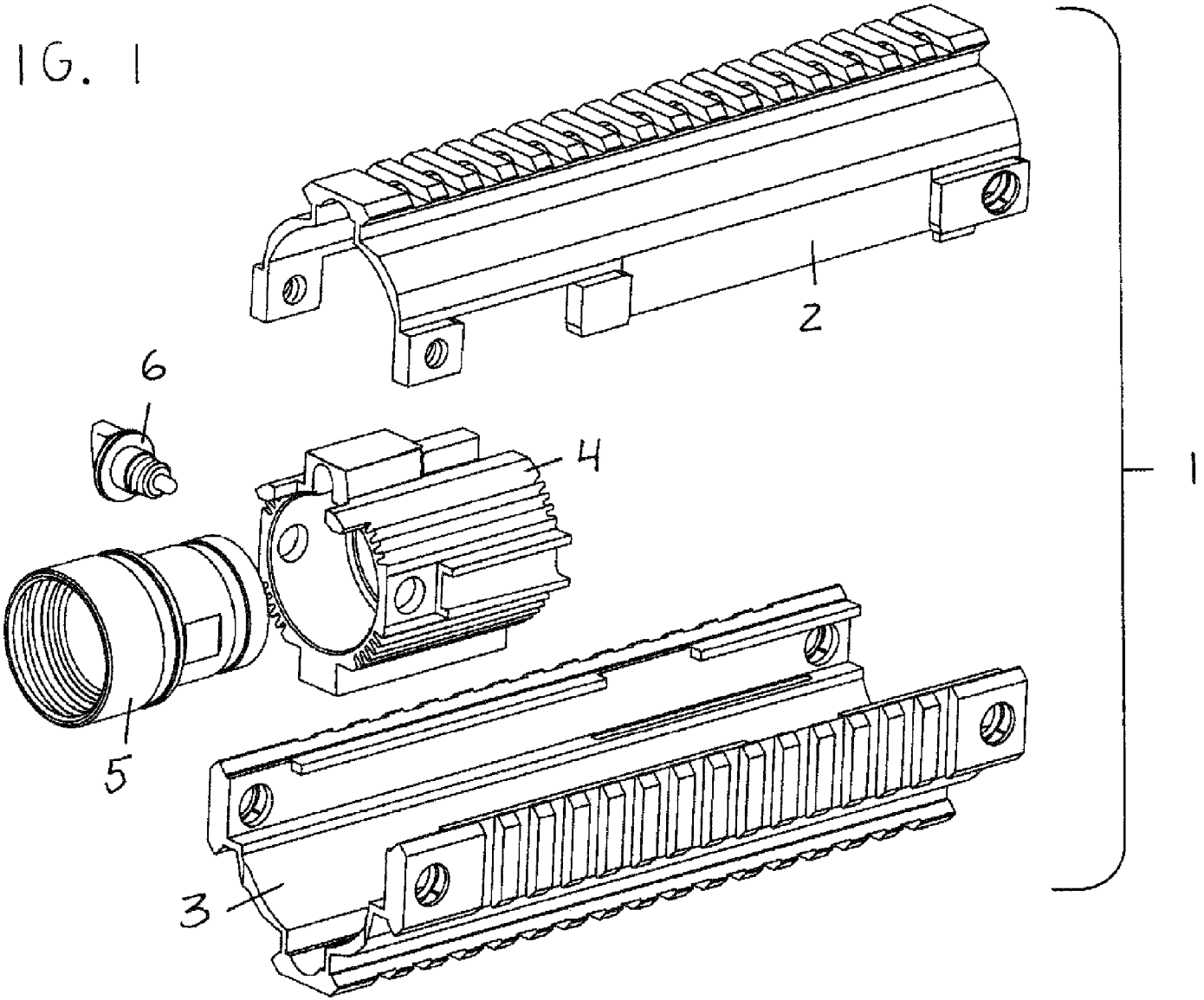
FIG. 1 is an exploded view of a first preferred embodiment of the present invention rifle hand guard assembly showing a top hand guard element, a bottom hand guard element, an inner barrel nut, a non-hinged outer barrel nut, and the spring-loaded detent screw that engages threads in one of the sling swivel recesses on the receiver end of the top hand guard element while at the same time putting pressure on both sides of the present invention hand guard to hold the top and bottom hand guard elements securely together against the outer barrel nut, wherein the receiver end of the assembly is positioned on the left in FIG. 1 and the barrel end of the assembly is positioned on the right.

The following detailed description of two most preferred embodiments of the present invention is merely exemplary in nature and is not intended as limiting to the scope and spirit of the present invention, or the application and uses of the present invention. Thus, as used herein, the word "exemplary" or "illustrative" should be construed to mean "serving as an example, instance, or illustration.", and any implementation described herein as "exemplary" or "illustrative" is not necessarily to be construed as preferred or advantageous over other disclosed implementations. It is also intended for the embodiments and other implementations described herein to enable persons skilled in the art to make or use the embodiments of the disclosure, and are not intended to limit the scope of the disclosure, which is defined by the accompanying claims. Also, for purposes of the description herein, the terms "upper", "lower", "left", right", "rear", "front", "vertical", "horizontal", and derivatives thereof shall relate to the invention as oriented in FIG. 1. It is also to be understood that the specific devices and processes illustrated in the attached drawings, and described in the specification herein, are simply exemplary embodiments of the inventive concepts defined in the appended claims. Hence, specific dimensions and other physical characteristics relating to the embodiments disclosed herein are not to be considered as limiting, unless the claims expressly state otherwise.

Two preferred embodiments of the present invention are illustrated in the accompanying drawing sheets and discussed in the following detailed description, and each is a quick-detach, free-floating, two-piece forward hand guard assembly (1 or 26) for a rifle with quad rail construction, and structure that includes an inner barrel nut (5 or 5') configured for a secure connection to the front portion of a rifle receiver 45 and a tubular interior passage configured for insertion of the rifle barrel 44 without contact therewith, an outer barrel nut (4 or 4') telescopically received over the inner barrel nut (5 or 5') and longitudinally secured thereto, a top hand guard element (2 or 2') mounted on the outer barrel nut, a bottom hand guard element 3 that is supported by the top hand guard element (2 or 2'), and one spring-loaded detent screw 6 inserted through one of the sling swivel recesses 11*a* (having a rotation limiter and no threads) located on the receiver end of bottom hand guard element 3 and engaged with the sling swivel recess 11 (having a rotation limiter and threads) that is located on the same side of the receiver end of top hand guard element 2 or 2' (selected according to whether the user is left-handed or right-handed) that tightly secures the top and bottom hand guard elements (2 or 2', and 3) together, and at the same time puts pressure on both sides of the present invention hand guard (2 or 2', and 3) due to the fact that the tip 25 of the spring detent screw 6 is in contact with the inner barrel nut (5 or 5') pushing away from the opposite side thereof. Tabs 13 and recesses 46 also help to secure the top and bottom hand guard elements (2 or 2', and 3) to one another. Furthermore, the outer barrel nut (4 or 4') is configured as a heat sink, non-rotatable with respect to the inner barrel nut (5 or 5'), and has tabs 22 on each side that slide over a portion of the upper receiver 45 (just under upper receiver Picatinny rails) when the outer barrel nut (4 or 4') is fully seated on the inner barrel nut (5 or 5'), helping to prevent side-to-side movement of the top and bottom hand guard elements (2 or 2', and 3). In addition, although heat venting holes 27 are only shown in the illustrations for the top and bottom hand guard elements 2' and 3 in the second preferred embodiment 26, it is considered to be within the scope of the present invention for its first preferred embodiment 1 to also have heat venting holes (same or different from those shown for second preferred embodiment 26). The second preferred embodiment 26 also allows for quick-detach removal of the rifle's barrel and provides an outer barrel nut 4' with a top split 38 and a bottom hinge 39 that together with top split 38 gives outer barrel nut 4' clamshell-type movement, an inner barrel nut 5' with a two-piece separable extension (33, 34—see FIG. 10), and aligned holes 28*a* and 28*b* in the outer barrel nut 4' and top hand guard element 2' that permit insertion of a tool for adjustment of the clamshell closing action for a proper fit on and around inner barrel nut 5'. FIGS. 1-14 illustrate the first preferred embodiment 1 of the present invention that allows quick-detachment of top and bottom hand guard elements (2 and 3), while FIGS. 15-28 illustrate the second preferred embodiment 26 that allows quick-detachment of top and bottom hand guard elements 2' and 3), but has additional structure that further allows quick-detach removal of the rifle's barrel 44 from its receiver 45 (See FIG. 28).

Figure 15:
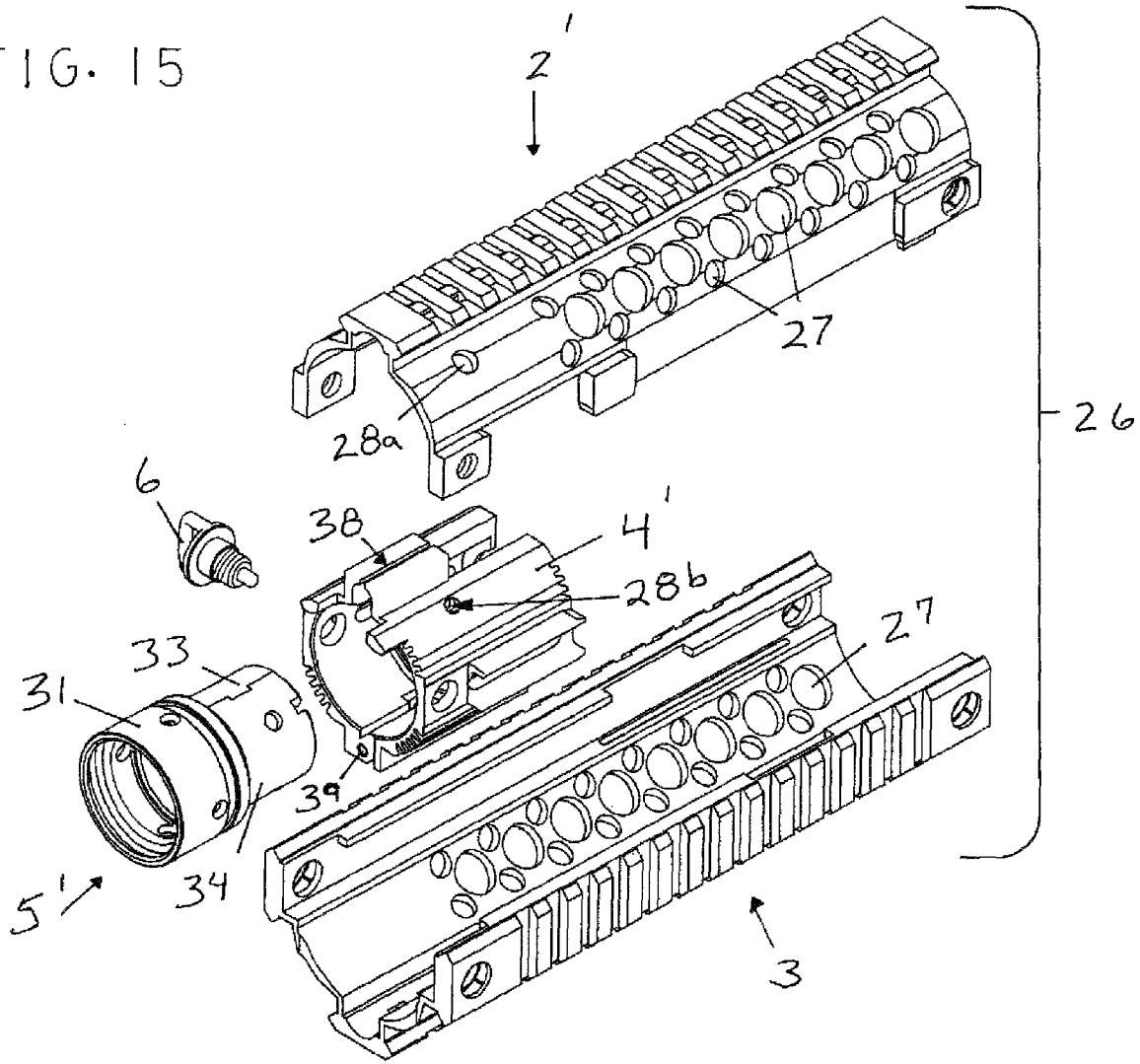
FIG. 15 is an exploded view of a second preferred embodiment of the present invention rifle hand guard assembly showing a top hand guard element with heat venting holes, a bottom hand guard element with heat venting holes, an inner barrel nut with a two-piece separable extension, a hinged outer barrel nut, aligned holes in the outer barrel nut and top hand guard member that permit adjustment of the clamshell-type of closing action allowed by the outer barrel nut's hinge, and the spring-loaded detent screw that engages one of the sling swivel recesses having threads located on the receiver end of the top hand guard element and when tightened secures the top and bottom hand guard elements together, while at the same time putting pressure on both sides of the present invention hand guard.

In an exploded view, FIG. 1 shows a first preferred embodiment 1 of the present invention as a quick-release, free-floating, two-piece forward hand guard assembly for a rifle with quad rail 7 construction. Its structure includes an inner barrel nut 5 configured for secure connection to the front portion of a rifle receiver 45 (see FIG. 28) while the rifle's barrel 44 (see FIG. 28) extends through the generally tubular interior passageway of inner barrel nut 5 without any contact therewith. First preferred embodiment 1 also includes an outer barrel nut 4 telescopically received over inner barrel nut 5 and longitudinally secured thereto via one or more circumferential recesses 48 in the exterior surface of inner barrel nut 4 and set screws (not shown, as any commonly available fastener fulfilling the function can be used) connected through fastener holes 19 (See FIG. 8). In addition first preferred embodiment 1 includes a top hand guard element 2 ready for mounting on outer barrel nut 4, a bottom hand guard element 3 that is positioned below outer barrel nut 4 and ready for free-floating support from top hand guard element 2 when locked to it (with no contact between rifle barrel 44 and top or bottom hand guard elements 2 and 3), and at least one spring-loaded detent screw 6 (and/or other fasteners) that can be inserted through one of the sling swivel recesses 11*a* (having a rotation limiter and no threads) located on the receiver end of bottom hand guard element 3 and engaged with the sling swivel recess 11 (having a rotation limiter and threads) located on the same side of the receiver end of top hand guard element 2 or 2' (selected according to whether the user is left-handed or right-handed) to tightly secure the top and bottom hand guard elements (2 and 3) together, and at the same time put pressure on both sides of the present invention hand guard (2 and 3) due to the fact that the tip 25 of the spring detent screw 6 is positioned against the inner barrel nut 5 and pushing away from the opposite side thereof. Top hand guard element 2 is engaged with, and extends forwardly from, outer barrel nut 4 in a laterally stable cantilevered fashion to cover the top portion of the rifle's barrel 44, and the bottom hand guard element 3 is matingly engaged with top hand guard element 2 and free-floating therefrom. Downward-facing tabs 13 in top hand guard element 2 and recesses 46 in bottom hand guard element 3 also help to secure the top and bottom hand guard elements (2 and 3) to one another. The bottom hand guard element 3 is preferably secured to top hand guard element 2 on its receiver end with one easily hand-manipulated spring-loaded detent screw 6 that extends through the outer barrel nut 4 and also engages the inner barrel nut 5 with spring-loaded tip 25. Furthermore, the outer barrel nut 4 is configured as a heat sink with radially-extending baffles, which work in combination with heat venting holes 27 (see FIG. 15 showing them as a part of second preferred embodiment 26) to dissipate heat generated in barrel 44 during weapon discharge. Outer barrel 4 is also non-rotatable with respect to inner barrel nut 5, and has spaced-apart tabs 22 on each side at its receiver end at the top that slide over a portion of the upper receiver 45 (just under upper receiver Picatinny rails) when the outer barrel nut 4 is fully seated on inner barrel nut 5, helping to prevent side-to-side movement of the top and bottom hand guard elements (2 and 3). Non-rotation of outer barrel nut 4 with respect to inner barrel nut 5 can be achieved using two recesses 48 encircling the circumference of inner barrel nut 5 and two recessed set screws (not shown) that extend through the bottom holes 19 of outer barrel nut 4 and protrude into the circumferential recesses 48 of inner barrel nut 5 to make contact with the exterior surface thereof. This arrangement prevents front and back motion of the top and bottom hand guard elements (2 and 3), while the spring-loaded detent screw 6 that extends through outer barrel nut 4 and also engages inner barrel nut 5, further helps to prevent side-to-side movement of the top and bottom hand guard elements (2 and 3) during their use. Additional features and advantages of first preferred embodiment 1 are revealed in the discussion below relating to FIGS. 1-14, and structural differences between first preferred embodiment 1 and second preferred embodiment 26 are explained below in the discussion relating to FIGS. 15-28.

Figure 2:
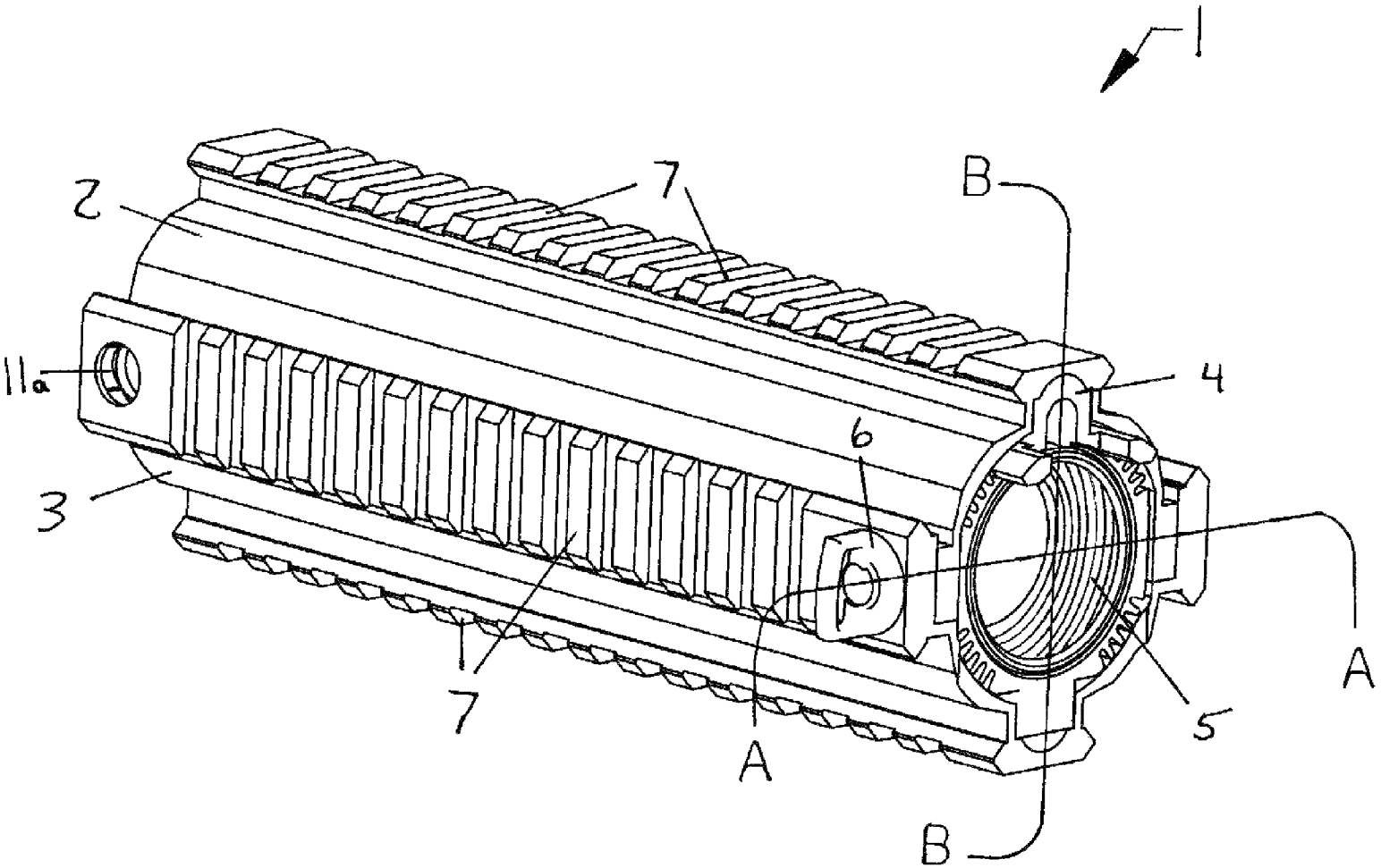
FIG. 2 is a perspective view of the first preferred embodiment of the present invention hand guard assembly from its right side and shown in an assembled configuration, with the receiver end of the assembly positioned on the right and the barrel end of the assembly positioned on the left.
Figure 3:
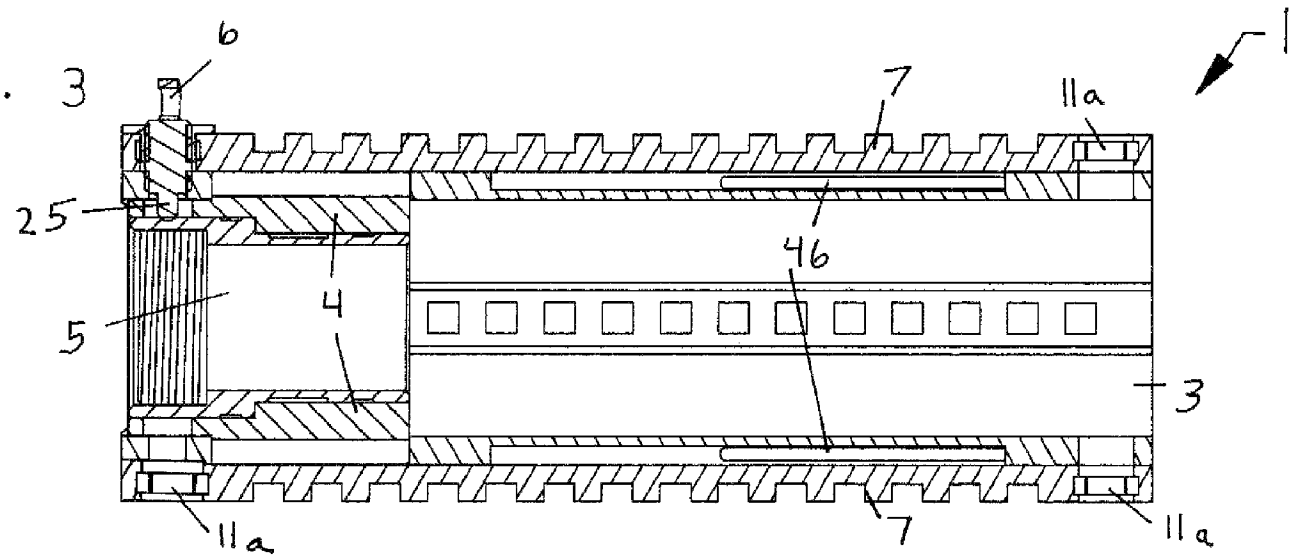
FIG. 3 is a sectioned side view of the first preferred embodiment of the present invention hand guard assembly taken along the lines A-A in FIG. 2 looking downwardly toward the bottom hand guard element.
Figure 4:
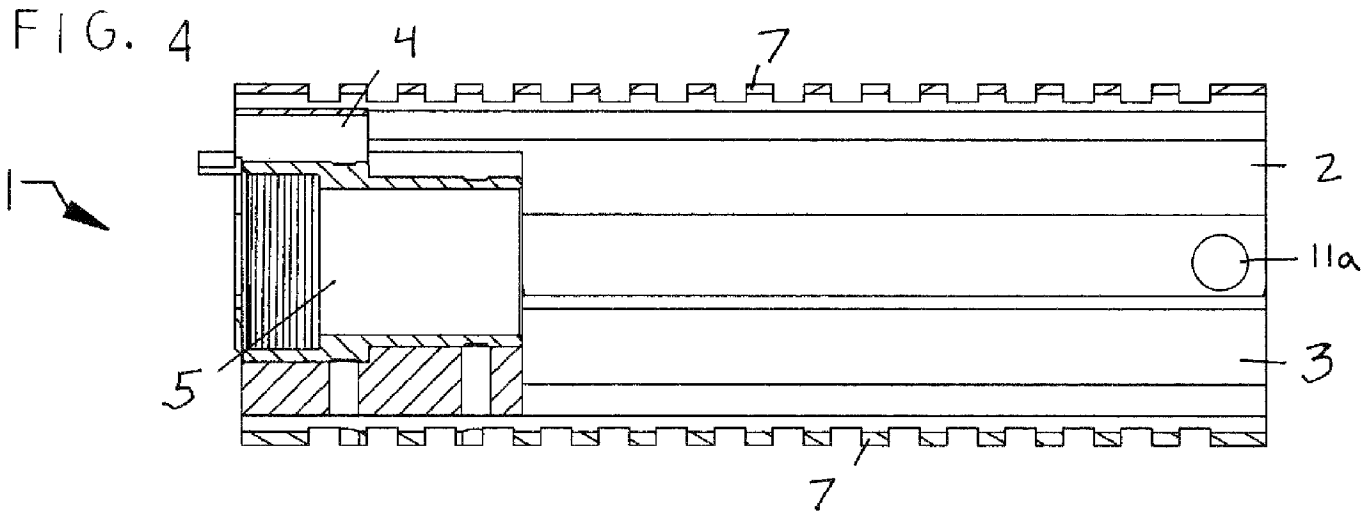
FIG. 4 is a sectioned side view of the first preferred embodiment of the present invention hand guard assembly taken along the lines B-B in FIG. 2.
Figure 5:
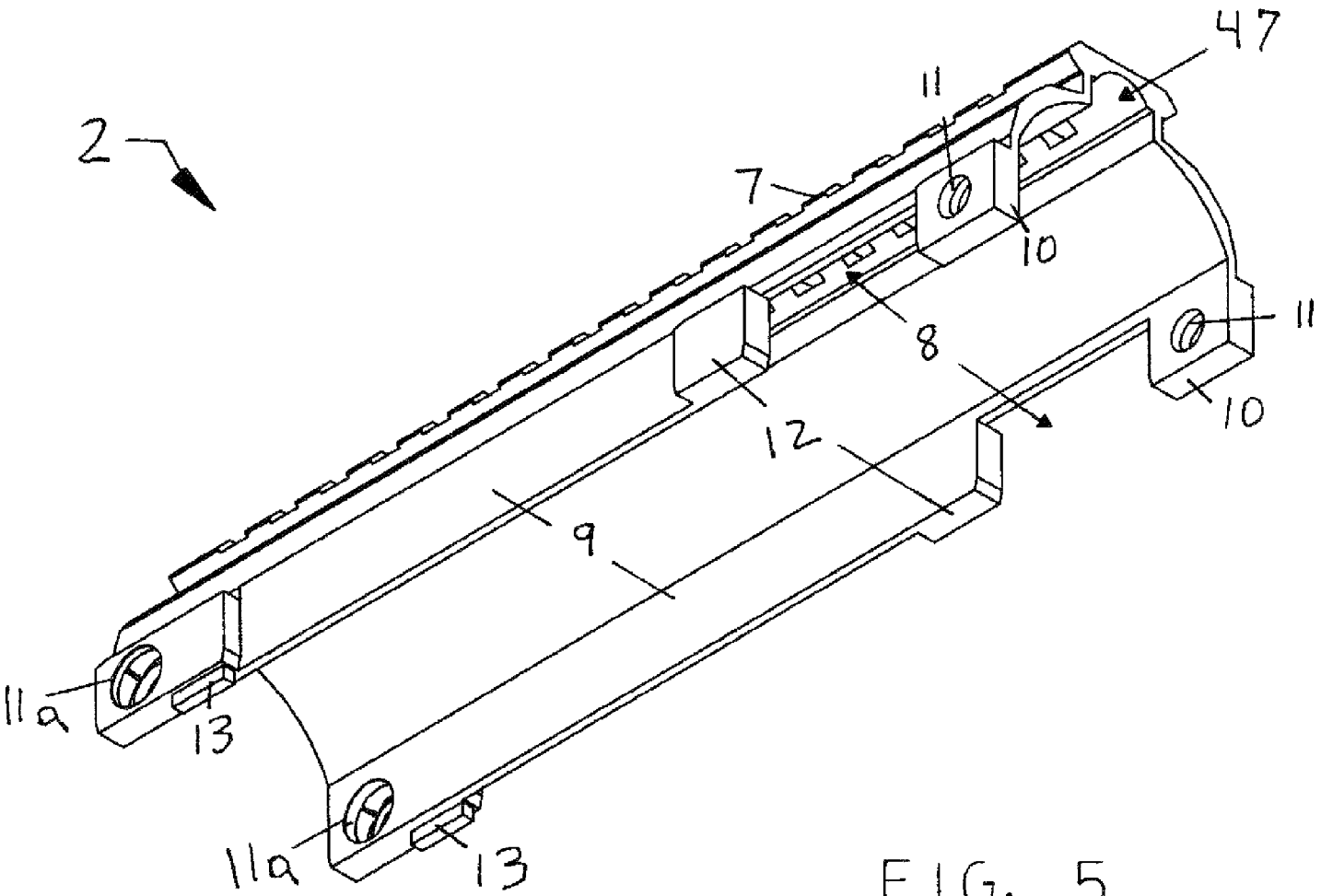
FIG. 5 is a perspective view from the bottom of the top hand guard element in the first preferred embodiment of the present invention, showing its top rail structure, laterally-opposed recesses, laterally-opposed raised protrusions, two laterally-opposed sling swivel recesses on its receiver end each having a rotation_limiter and also having threads for engagement with the spring-loaded detent screw, two laterally opposed sling swivel recesses on its barrel end which only have rotation limiters and no threads, and laterally-opposed bottom lugs.

FIGS. 2-4 show first preferred embodiment 1 in its assembled configuration. FIG. 2 shows first preferred embodiment 1 from its right side with the receiver end thereof on the right of the illustration and the barrel end thereof on the left. Section lines A-A and B-B are also marked on one end of first preferred embodiment 1 in FIG. 1 to use as a reference understanding the illustrations in FIGS. 3 and 4. FIG. 3 is a sectioned side view of first preferred embodiment 1 taken along the lines A-A and looking downwardly toward bottom hand guard element 3, while FIG. 4 is a sectioned side view of first preferred embodiment 1 taken along the lines B-B in FIG. 2. The receiver end of first preferred embodiment 1 in both FIG. 3 and FIG. 4 is positioned on the left of the illustration, and its barrel end is positioned to the right. To reduce repetition of structural information about top and bottom hand guard elements 2 and 3, the following discussion of first preferred embodiment 1 in its assembled configuration in FIGS. 2-4 will also include structure identified by numerical designation in FIGS. 5 and 6. FIG. 5 is a perspective view from the bottom of top hand guard element 2 in first preferred embodiment 1 that shows its top rail structure 7, recesses 8, raised protrusions 10 and 12, two sling swivel recesses 11*a* each having a rotation limiter and no threads that are located on its barrel end, two sling swivel recesses 11 each having a rotation limiter and threads that are located on its receiver end, and bottom lugs 13. In contrast, FIG. 6 is a perspective view from the top of bottom hand guard element 3 in first preferred embodiment 1 that shows its three rail structures 7, opposed middle recesses 14, raised protrusions 15 and 16, four sling swivel recesses 11*a* each having a rotation limiter and no threads, and side channels 46 into which the bottom lugs 13 on top hand guard element 2 are inserted to help secure the top and bottom hand guard elements (2, 3) together.

FIG. 2 shows top hand guard element 2 mated with bottom guard element 3 to form a generally tubular configuration, with the one axially-aligned accessory mounting rail 7 on the top exterior surface of top hand guard element 2, which in combination with the three axially-aligned accessory mounting rails 7 on the side and bottom exterior surfaces of bottom hand guard element 3 forming a quad rail configuration. Accessory mounting rails 7 may be of any configuration that accepts rifle accessories (not shown) adapted for mounting on a rifle such as telescopic sights, flashlights, and the like. As such, and as shown, the accessory mounting rails 7 on top and bottom hand guard elements 2 and 3 conform to MIL-STD-1913 or STANAG 2324, the details of which are well-known in the art and are not described further herein. FIG. 2 also shows outer barrel nut 4 positioned between top hand guard element 2 and bottom hand guard element 3, with inner barrel nut 5 concentrically positioned within outer barrel nut 4. FIG. 2 further shows the threaded receiver end of inner barrel nut 5 that is configured to mate with threads (not shown) on a rifle's forward receiver 45. Although heat venting holes (see FIG. 15 for an example of heat venting holes 27 used in the top and bottom hand guard elements in second preferred embodiment 26) are typically used in first preferred embodiment 1, the number, size, placement, and spaced-apart relation of heat venting holes 27 used is not critical. In addition, FIG. 2 shows a spring-loaded detent screw 6 inserted within and covering a sling swivel recess 11 (having a rotation limiter and threads) located on the receiver end of top hand guard element 2 which when tightened secures top hand guard element 2 to bottom hand guard element 3, while at the same time putting pressure on both sides of the present invention hand guard due to the fact that the tip of spring-loaded detent screw 6 is against inner barrel nut 5 pushing away from the opposite side thereof, with bottom hand guard element 3 remaining free-floating with respect to top hand guard element 2 and having no contact with rifle barrel 44.

Figure 6:
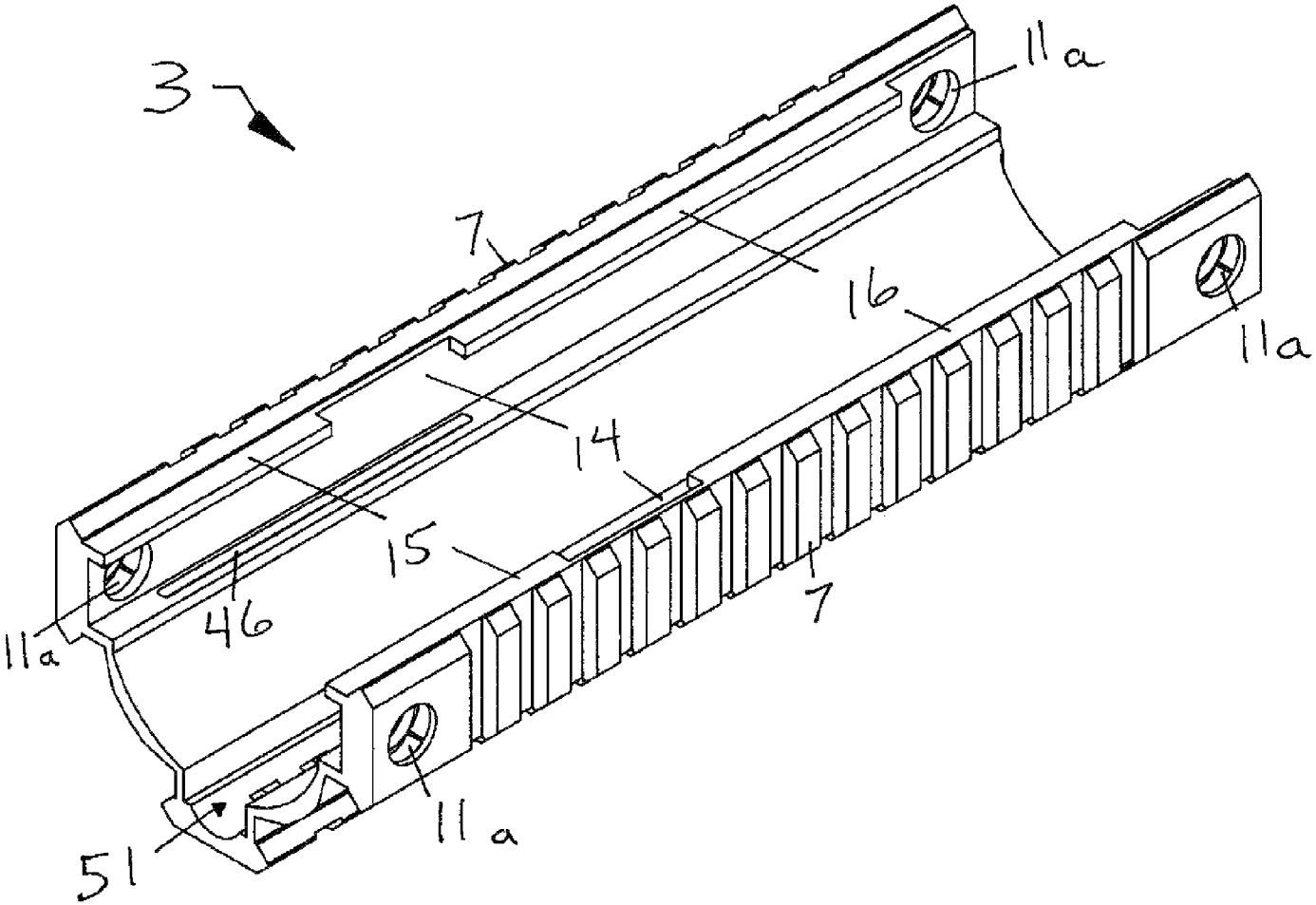
FIG. 6 is a perspective view from the top of the bottom hand guard element in the first preferred embodiment of the present invention, showing its three rail structures, laterally-opposed middle recesses, laterally-opposed raised protrusions, four sling swivel recesses each having rotation limiters and no threads, and laterally-opposed side channels into which the bottom lugs on the top hand guard element are inserted to help secure the top and bottom hand guard elements together.

While FIG. 2 shows external structure of first preferred embodiment 1, FIGS. 3-6 illustrate internal structure that allows top hand guard element 2 and bottom hand guard element 3 to remain securely connected to one another while supported by outer barrel nut 4 in a laterally-stable cantilevered fashion. FIGS. 3 and 4 show outer barrel nut 4 positioned within the joined top hand guard element 2 and bottom hand guard element 3, with inner barrel nut 5 concentrically positioned within outer barrel nut 4. FIG. 3 also shows a spring-loaded detent screw 6 engaged with one sling swivel recess 11 (each having a rotation limiter and threads) that is located on the receiver end of top hand guard element 2 to tightly secure top and bottom hand guard elements together, and at the same time put pressure on both sides of the present invention hand guard due to the fact that the tip 25 of the spring-loaded detent screw 6 contacts the exterior surface of inner barrel nut 5 pushing away from the opposite side thereof. In addition, the opposed side mounting rails 7 are shown in FIG. 3 and opposed top and bottom accessory mounting rails 7 are shown in FIG. 4, with FIG. 3 also showing the centrally-extending interior surface of the bottom rail 7. In addition, FIG. 3 shows the side channels 46 in bottom hand guard element 3 into which the opposed bottom lugs 13 on top hand guard element 2 are inserted to help secure the top and bottom hand guard elements (2 and 3) together. FIG. 5 further shows that top hand guard element 2 only has one accessory mounting rail 7 on its exterior top surface, and that top hand guard element 2 comprises two sling swivel recesses 11 (each having a rotation limiter and threads) located on its receiver end and two sling swivel recesses 11*a* (each having a rotation limiter and no threads) located on its barrel end. In addition, FIG. 5 shows the opposed recesses 8 in the sides of top hand guard element 2 each between a different one of the raised corner protrusions 10 at the receiver end thereof and an adjacent raised protrusion 12. FIG. 5 also shows the preferred non-recessed configuration 9 extending between each raised protrusion 12 and the adjacent raised sling swivel recesses 11*a* (each having a rotation limiter and no threads) located near the barrel end of top hand guard element 2. The bottom lugs 13 on top hand guard element 2 are also shown in FIG. 5 to be positioned near the barrel end of non-recessed configuration 9. In addition, FIG. 6 further confirms that bottom hand guard element 3 has four sling swivel recesses 11*a* (each having a rotation limiter and no threads) that are located on its barrel end and three accessory mounting rails 7. FIG. 6 also shows the opposed middle recesses 14 in the sides of bottom hand guard element 3 that are positioned above one end of a channel 46 configured to receive one of the bottom lugs 13 on the barrel end of top hand guard element 2 as bottom hand guard element 3 is moved into its locked free-floating position of use while supported by top hand guard element 2. FIG. 6 also shows a raised protrusion 15 on the barrel end of each recess 14 and a longer raised protrusion 16 on the receiver end of each recess 14. FIGS. 5 and 6 also respectively show the top interior receiving structure 47 of top hand guard element 2 and the bottom interior receiving structure 51 of bottom hand guard element 3 that receive and engage the top and bottom stabilizing projections 17 and 18 of outer barrel nut 4 to prevent side-to-side movement of the top and bottom hand guard elements 2 and 3 during their use. The stabilizing projections 17 and 18 of outer barrel nut 4 are respectively configured to fit tightly within the interior receiving structures 47 and 51. Inner and outer barrel nuts 5 and 4 can remain attached to a rifle's receiver 45 and do not require removal therefrom to facilitate the removal of top and bottom hand guard elements 2 and 3.

Figure 7:
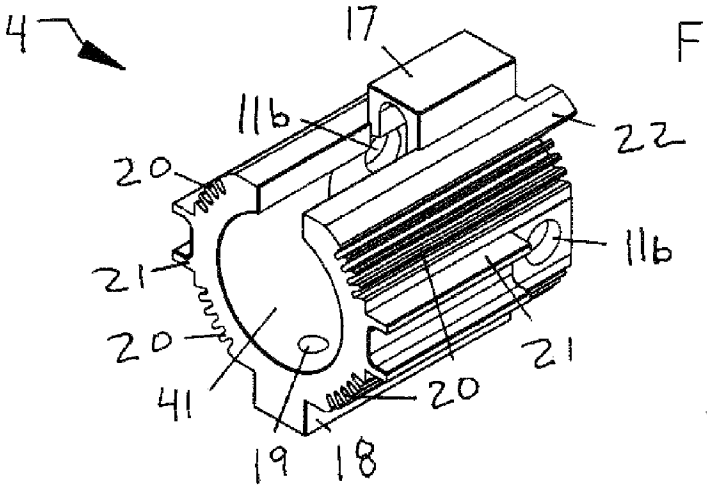
FIG. 7 is a perspective view from the top showing the left side of the outer barrel nut in the first preferred embodiment of the present invention, with its laterally-extending side lugs, rearward-facing tabs used for receiver connection, two opposed non-threaded holes aligned with the sling swivel recesses having rotation limiters and threads that are located on the receiver end of the top hand guard element and which are used for insertion of the spring-loaded detent screw to allow engagement of its tip with the outer surface of the inner barrel nut, radially-extending baffles used for heat dissipation, a top stabilizing member that engages structure in the top hand guard element to prevent side-to-side movement of the top hand guard element, a bottom stabilizing member that engages structure in the bottom hand guard element to prevent side-to-side movement of the bottom hand guard element, and one of the bottom holes that allows secure connection of the outer barrel nut to the inner barrel nut via recessed set screws.
Figure 9:
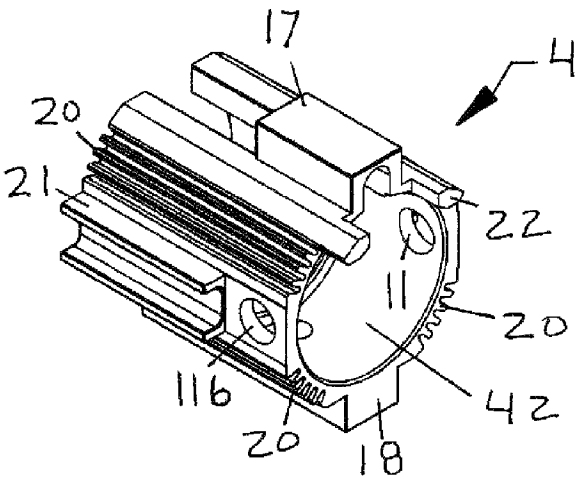
FIG. 9 is top perspective view from the top of the right side of the outer barrel nut in the first preferred embodiment of the present invention, and showing structure similar to that shown in FIGS. 7 and 8 for its left side.
Figure 8:
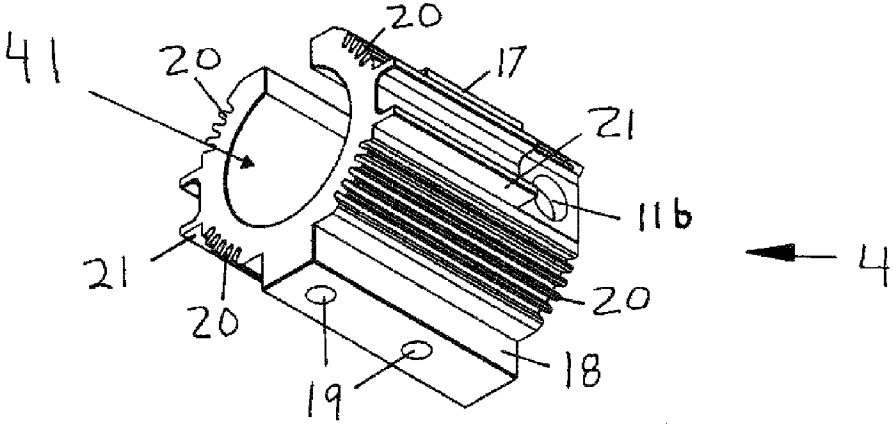
FIG. 8 is a perspective view from the bottom showing the left side of the outer barrel nut in the first preferred embodiment of the present invention and more detail for its bottom stabilizing member, including the two bottom holes preferably used for set screw attachment to the inner barrel nut.

FIGS. 7-9 show preferred structure for the outer barrel nut 4 in the first preferred embodiment 1 of the present invention. FIG. 7 is a perspective view from the top showing the left side of the outer barrel nut 4, with its barrel end 41 facing the viewer and the receiver end 42 (Shown in FIG. 9) of outer barrel nut 4 (with its spaced-apart tabs 22) having remote positioning. Outer barrel nut 4 defines a central passageway 41/42 having a diameter dimension configured to closely receive inner barrel nut 5 therein in a telescopic manner. FIG. 7 shows outer barrel nut 4 having two laterally-extending side lugs 21 with opposed positioning from one another, rearward-facing tabs 22 used for connection of outer barrel nut 4 with a rifle's receiver 45, two opposed non-threaded holes 11*b* aligned with the sling swivel recesses 11 (each having rotation limiters and threads) that are located on the receiver end of the top hand guard element 2 and through which the spring-loaded tip 25 of detent screw 6 may extend to engage the exterior surface of inner barrel nut 5, four sets of radially-extending baffles 20 used for dissipation of heat energy created by the hot gasses and friction generated by projectiles (not shown) traveling through the interior longitudinal bore of barrel 44 during weapon firing, a top stabilizing member 17 that engages receiving structure 47 in the top interior surface of top hand guard element 2 to prevent side-to-side movement thereof during use, a bottom stabilizing member 18 that engages receiving structure 51 in the bottom interior surface of bottom hand guard element 3 to prevent side-to-side movement thereof during use, and one of the bottom holes 19 in outer barrel nut 4 that provides its secure connection to inner barrel nut 5 when recessed set screws (not shown) are tightened in them. In contrast, FIG. 8 is a perspective view from the bottom showing the same left side of outer barrel nut 4, but providing more detail about its bottom stabilizing member 18, including the two bottom holes 19 preferably used for fixed set screw attachment (not shown) of outer barrel nut 4 to inner barrel nut 5. While opposed side lugs 21, the four sets of radially-extending baffles 20, and one non-threaded hole 11*b* are visible in FIG. 8, the two spaced-apart tabs 22 on the receiver 42 end of outer barrel nut 4 are not visible in FIG. 8. FIG. 9 is perspective view from the top of the right side of outer barrel nut 4 that shows structure similar to that shown in FIGS. 7 and 8 for its left side. In addition, FIG. 9 confirms that outer barrel nut 4 has two spaced-apart tabs 22 and two non-threaded holes 11*b* near its receiver end 42 through which the spring-loaded tip 25 of detent screw 6 extends for engagement of the exterior surface of inner barrel nut 5. The spacing of tabs 22 is such to closely receive therebetween a forward portion of rifle receiver 45, and when outer barrel nut 4 is translated axially back so that the upper forward portion of receiver 45 is captured between tabs 22, holes 19 become aligned with the circumferential recesses 48 on the exterior surface of inner barrel nut 5. Set screws (not shown) are then threaded into holes 19 and torqued to securely seat them against the exterior circumferential recesses 48 of inner barrel nut 5. In this manner, tabs 22 closely receiving the front portion of receiver 45 prevent outer barrel nut 4 from rotating about inner barrel nut 5, and set screws firmly torqued in holes 19 to engage the exterior circumferential recesses 48 of inner barrel nut 5 maintain outer barrel nut 4 in a fixed longitudinal position with respect to inner barrel nut 5. Although not limited thereto, in first preferred embodiment 1 outer barrel nut 4 is made from aluminum extrusion and has a hard black anodized finish.

Figure 10:
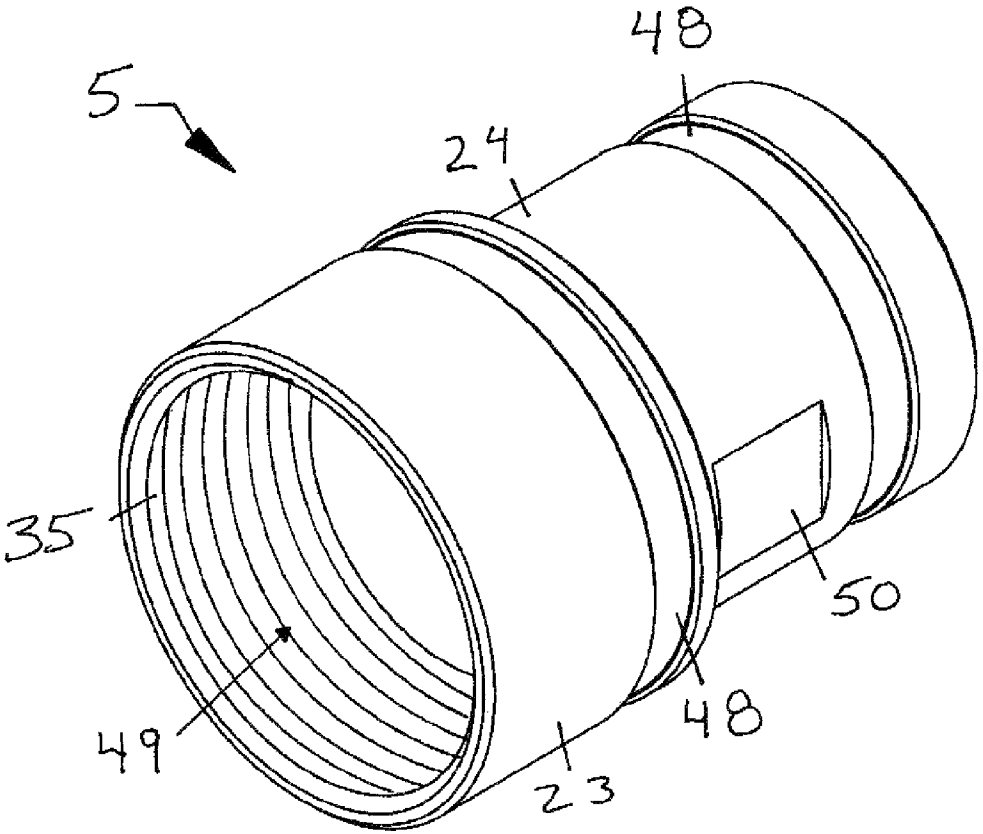
FIG. 10 is a perspective view of the inner barrel nut in the first preferred embodiment of the present invention, and showing the two circumferential recesses used for set screw connection of the outer barrel nut.

FIG. 10 shows inner barrel nut 5 having a generally tubular configuration that defines a central passage 49 with a ring-shaped member 23 on its receiver end and an extension 24 with a slot 50 therethrough on its barrel end. Ring-shaped member 23 has internal female threads 35 configured to mate with and receive the male threads (not shown) of the forward end of a rifle receiver 45 (see FIG. 28). The tubular configuration of inner barrel nut 5 includes a central axis that corresponds to the central axis of the bore of rifle barrel 44 (see FIG. 28). Those practiced in the art will readily understand that the external male threads on receiver 45 may be different on different rifle designs and as a result internal threads 35 on the receiver end of inner barrel nut 5 may be adapted to the particular design of rifle receiver 45 so that inner barrel nut 5 may be securely affixed to receiver 45 during use of preferred embodiments of the present invention (1, 26, and other). Central passage 49 permits inner barrel nut 5 to be sleeved over the barrel 44 of a rifle once its threaded connection to receiver 45 is made. Inner barrel nut 5 may also include a slot 50 configured for receiving an end of a spanner wrench (not shown) for tightening inner barrel nut 5 onto receiver 45 in a manner common to, and known by, those practiced in the art. Inner barrel nut 5 further defines at least one (and most preferably two) circumferential recesses 48 axially or longitudinally spaced one from the other and extending about an external periphery of inner barrel nut 5. Circumferential recesses 48 are used for set screw connection of outer barrel nut 4 thereto, such as and including the tip 25 of a spring-loaded detent screw 6 that is used through one of the non-threaded holes 11*b* in outer barrel nut 4. The size, configuration, and positioning of the circumferential recesses 48 and slot 50 may be different from that shown in FIG. 10 as long as they fulfill their intended functions. Although not limited thereto, in first preferred embodiment 1 inner barrel nut 5 is made from stainless steel and has a hard chrome finish.

FIGS. 11-14 show a quick-release spring-loaded detent screw 6 that can be used with preferred embodiments (1, 26, and other) of the present invention to engage one sling swivel recess 11 (having a rotation limiter and threads) on the receiver end of top hand guard element (2 or 2') to tightly secure the top and bottom hand guard element (2 or 2') together, and at the same time put pressure on both sides of the joined hand guard elements (2 or 2', and 3) due to the fact that the tip 25 of the spring-loaded detent screw 6 engages the exterior surface of inner barrel nut 5 pushing away from the opposite side thereof. In addition to the needed spring plunger portion 24 of spring-loaded detent screw 6, the fastener used with top and bottom hand guard elements (2 or 2', and 3) should be easily hand-manipulated and have quick-release operation for quick disassembly and subsequent assembly of top and bottom hand guard elements (2 or 2', and 3) one to the other. FIGS. 11 and 13 are perspective views of the quick-release spring-loaded detent screw 6 used with the most preferred embodiments of the present invention, while FIG. 12 illustrates the spring plunger portion 24 of the detent screw 6 with a biasing tip 25 and FIG. 14 illustrates preferred structure for the easily hand-manipulated 'handle' portion 23 of spring-loaded detent screw 6. Although not limited thereto, in first preferred embodiment 1 quick-release spring-loaded detent screw 6 is made from stainless steel.

FIG. 15 is an exploded view of a second preferred embodiment 26 of the present invention rifle hand guard assembly showing a top hand guard element 2' with heat venting holes 27, a bottom hand guard element 3 with heat venting holes 27, an inner barrel nut 5' with a ring-shaped member and a two-piece separable extension 33/34, an outer barrel nut 4' with a hinge 39 and a top split 38 that permits clamshell closing action of hinged outer barrel nut 4' around inner barrel nut 5', and aligned holes **28*b* and 28*a* respectively in the outer barrel nut 4' and top hand guard element 2' that permit insertion of a tool (not shown) for adjustment of the clamshell closing action to provide a proper fit for the outer barrel nut 4' on and around the inner barrel nut 5'. FIG. 15 also shows a spring-loaded detent screw 6 that fits into one sling swivel recess 11 (having a rotation limiter and threads) on the receiver end of top hand guard element 2' to tightly secure the top and bottom hand guard elements (2' and 3) together (the recess selected depends on whether the user is right-handed or left-handed), and at the same time putting pressure on both sides of the joined hand guard elements (2' and 3) due to the fact that the tip 25 of the spring-loaded detent screw 6 is against the exterior surface of inner barrel nut 5 pushing away from the opposite side thereof. To adjust the clamshell closing action in outer barrel nut 4', a threaded hole 28*b* is provided on the upper portion of outer barrel nut 4' and a preferably non-threaded hole 28*a* is provided in a position on top hand guard element 2' so that holes 28*a* and 28*b* become aligned with one another. A screw (not shown) is positioned within the threaded hole 28*b* in outer barrel nut 4' and tightened so that its distal end engages the exterior surface of inner barrel nut 5' and the non-threaded hole 28*a* provided in top hand guard element 2' is made sufficiently large (typically larger in diameter dimension than threaded hole 28*a*, although not limited thereto) for insertion of a tool (not shown) that can be employed to tighten or loosen the screw (not shown) within threaded hole 28*a*. Since the inner barrel nut 5' in second preferred embodiment 26 has a two-piece separable extension 33/34, its ring-shaped receiver portion 31 can remain fixed to the front portion of the rifle receiver 45 while the two-piece extension 33/34 is removed, thus allowing for quick-detach removal of barrel 44 from receiver 45, if needed, promptly after the joined top and bottom hand guard elements (2' and 3) have been removed from around barrel 44. The outer barrel nut 4' in the second preferred embodiment 26 also includes rearwardly-extending tabs 22 that are laterally spaced one from the other to closely receive the front portion of the rifle receiver 45 therebetween. When the top and bottom hand guard elements (2' and 3) in second preferred embodiment 26 are attached one to the other with a spring-loaded detent screw 6, they become secured on their receiver ends against outer barrel nut 4' while their opposed barrel ends remain free-floating with respect to rifle barrel 44 in a laterally-stable cantilevered fashion. Such connection also creates pressure on both sides of outer barrel nut 4' to prevent inner barrel nut 5' from pushing away from the opposite side of outer barrel nut 4' and allow second preferred embodiment 26** to hold tight and true and not cause any adverse interference with weapon accuracy.

Figure 16:
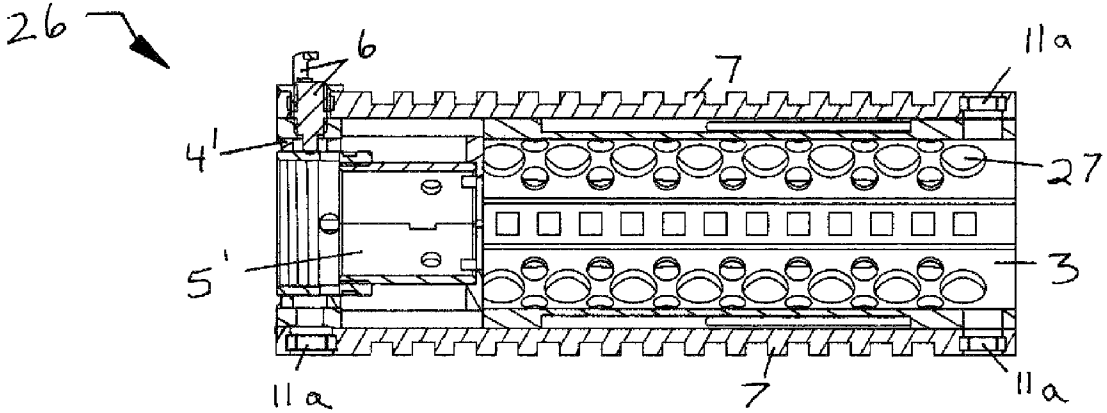
FIG. 16 is a sectioned view of the second preferred embodiment hand guard assembly in an assembled configuration, taken from the line A-A in FIG. 17 and looking downward toward the bottom hand guard element, with the receiver end of the assembly positioned on the left and the barrel end of the assembly positioned on the right.
Figure 17:
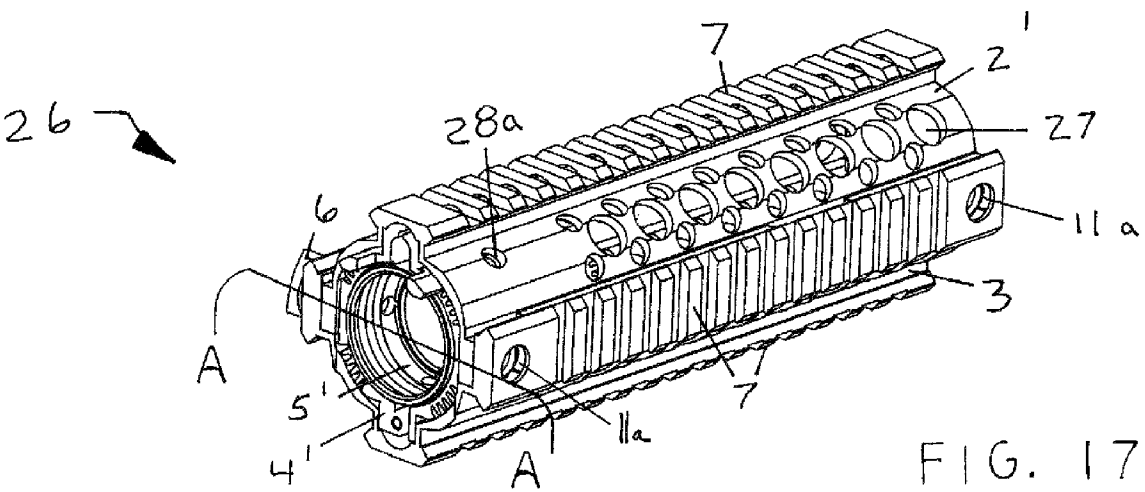
FIG. 17 is a perspective view of the second preferred embodiment hand guard assembly from its left side and shown in an assembled configuration, with the receiver end of the assembly positioned on the left and the barrel end of the assembly positioned on the right.
Figure 18:
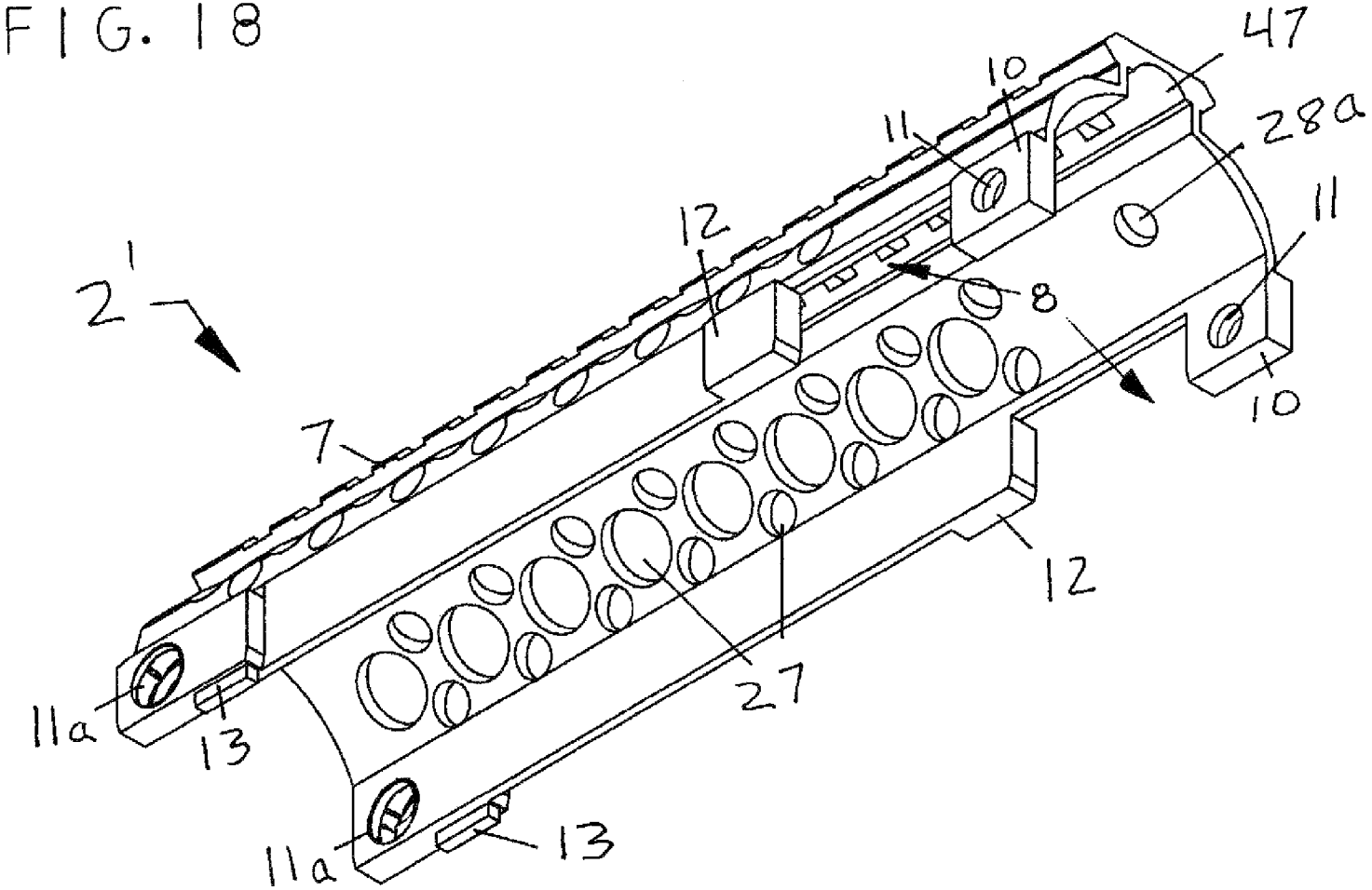
FIG. 18 is a perspective view from the bottom of the top hand guard element in the second preferred embodiment of the present invention, showing its top rail structure, heat venting holes, laterally-opposed recesses, laterally-opposed raised protrusions, two laterally-opposed sling swivel recesses on its receiver end each having a rotation limiter and also having threads for engagement with the spring-loaded detent screw, two laterally opposed sling swivel recesses on its barrel end which only have rotation limiters and no threads, clamshell-action adjustment hole, and laterally-opposed bottom lugs.
Figure 19:
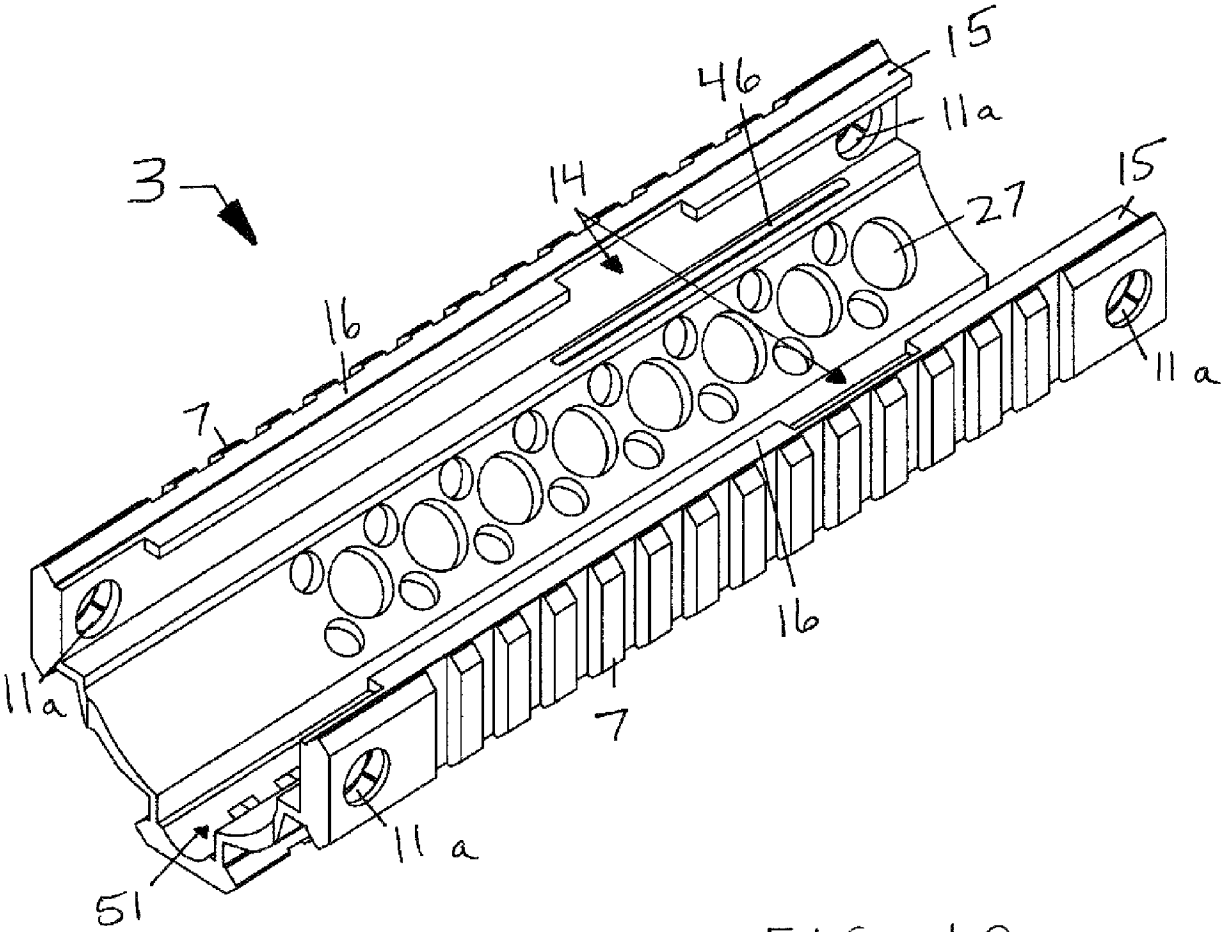
FIG. 19 is a perspective view from the top of the bottom hand guard element in the second preferred embodiment of the present invention, showing its showing its three rail structures, laterally-opposed middle recesses, laterally-opposed raised protrusions, four sling swivel recesses each having rotation limiters and no threads, and laterally-opposed side channels into which the bottom lugs on the top hand guard element are inserted to help secure the top and bottom hand guard elements together.

FIGS. 16 and 17 show second preferred embodiment 26 of the present invention rifle hand guard assembly in its assembled configuration. Section lines A-A are marked in FIG. 17 on one end of second preferred embodiment 26 to use as a reference for understanding the sectioned view shown in FIG. 16, which looks downward toward bottom hand guard element 3. In both FIG. 16 and FIG. 17, the receiver end of second preferred embodiment 26 is on the left of the illustration and its opposing barrel end on the right. FIG. 17 is not a sectioned view, but instead provides a perspective view of second preferred embodiment 26 in an assembled configuration from its left side. To reduce repetition of structural information about the top and bottom hand guard elements 2' and 3 in the second preferred embodiment 26, the following discussion of second preferred embodiment 26 in its assembled configuration in FIGS. 16 and 17 will also include structure identified by numerical designation in FIGS. 18 and 19. FIG. 18 is a perspective view from the bottom of top hand guard element 2' that shows its top accessory mounting rail structure 7, heat venting holes 27, recesses 8, raised protrusions 10 and 12, two sling swivel recesses 11 (each having a rotation limiter and threads) located on its receiver end and used to tightly secure top and bottom hand guard elements (2' and 3) together, two sling swivel recesses **11*a* (each having a rotation limiter and no threads) located on its barrel end, clamshell-action adjustment hole 28*a*, and bottom lugs 13. In contrast, FIG. 19 is a perspective view from the top of bottom hand guard element 3 that shows its three accessory mounting rail structures 7 (opposed side rails 7 and bottom rail 7), heat venting holes 27, opposed middle recesses 14, raised protrusions 15 and 16, sling swivel recesses 11*a* (each having a rotation limiter and no threads), and side channels 46 into which the bottom lugs 13 on top hand guard element 2 are inserted to help secure the top and bottom hand guard elements (2', 3) together. To achieve quick and easy installation of top hand guard element 2' and bottom hand guard element 3, the top hand guard element 2' has two upper female recesses 8 in opposed positions that during installation allow it to slide on and around raised lugs 21 on the left and right sides of the outer barrel nut 4' with a downward push. Additional lower recesses 14 about midway on the bottom hand guard element 3 are configured to allow raised lugs 10 positioned forward from upper recesses 8 to slide into them, and pushing the bottom hand guard element 3 in an upward direction then allows it to slide in a backward motion that locks it to the top hand guard element 2' and against the outer barrel nut 4' approximately one-inch forward of the back half of outer barrel nut 4'. A spring-loaded detent screw 6 inserted through one of the sling swivel recesses 11*a* (each having a rotation limiter and no threads) located on the receiver end of bottom hand guard element 3 and engaged with the sling swivel recess 11 (having a rotation limiter and threads) located on the same side of the receiver end of top hand guard element 2' (selected according to whether the user is left-handed or right-handed) tightly secures top and bottom hand guard elements (2' and 3) together, and at the same time puts pressure on both sides of the present invention hand guard (2' and 3) due to the fact that the tip 25 of the spring detent 6 is against the inner barrel nut 5' pushing away from the opposite side thereof. What sets the present invention hand guard assembly (1, 26, and other) apart from all others is structure allowing unique assembly and disassembly, and the first 2.25-inches of the end closest thereof to a rifle's receiver 45 (See FIG. 28**) is where most of the mechanics take place.

Figure 20:
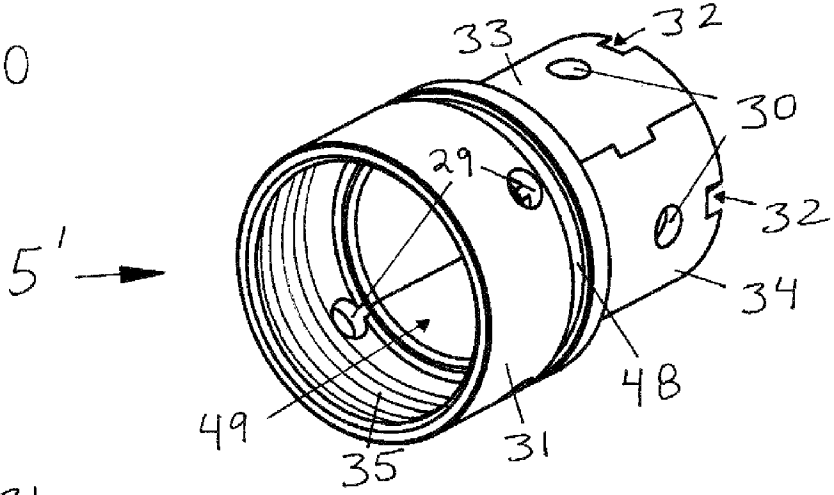
FIG. 20 is a perspective view of the left side of the inner barrel nut in the second preferred embodiment of the present invention, showing its circumferential recess, two-piece separable extension, side openings that assist installation/removal, and forward end indentations that also can be used to assist installation/removal.
Figure 21:
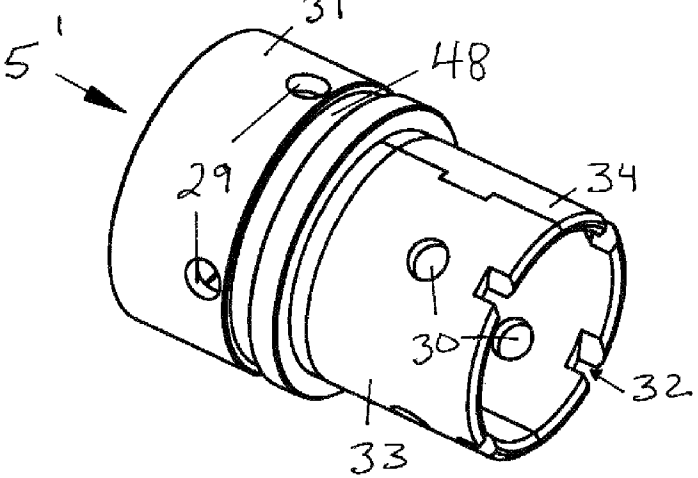
FIG. 21 is a perspective view of the right side of the inner barrel nut shown in FIG. 20, and further showing internal threads used for connection to the two-piece inner barrel nut extension shown in FIGS. 19, 20, and 24.
Figure 22:
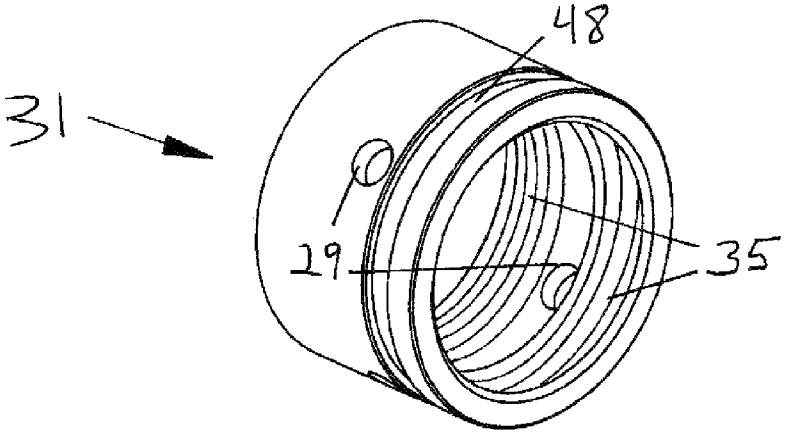
FIG. 22 is a perspective view from the left side of the receiver portion of the inner barrel nut shown in FIGS. 20 and 21, and further showing internal threads used for connection to the two-piece inner barrel nut extension shown in FIGS. 20, 21, and 24.
Figure 23:
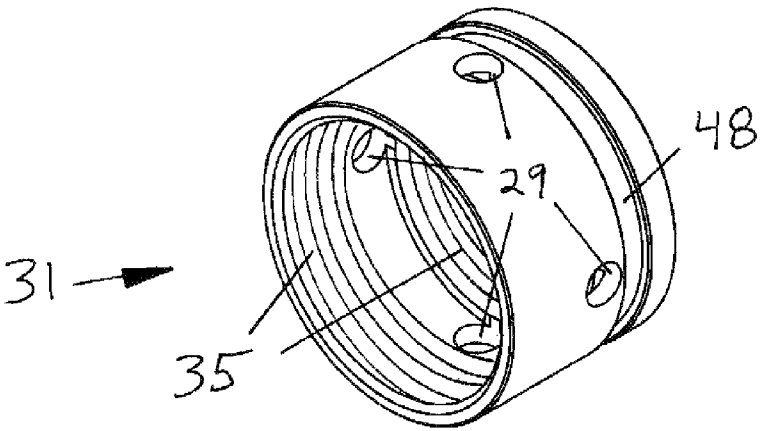
FIG. 23 is perspective view from the right side of the receiver portion of the inner barrel nut shown in FIG. 22.
Figure 24:
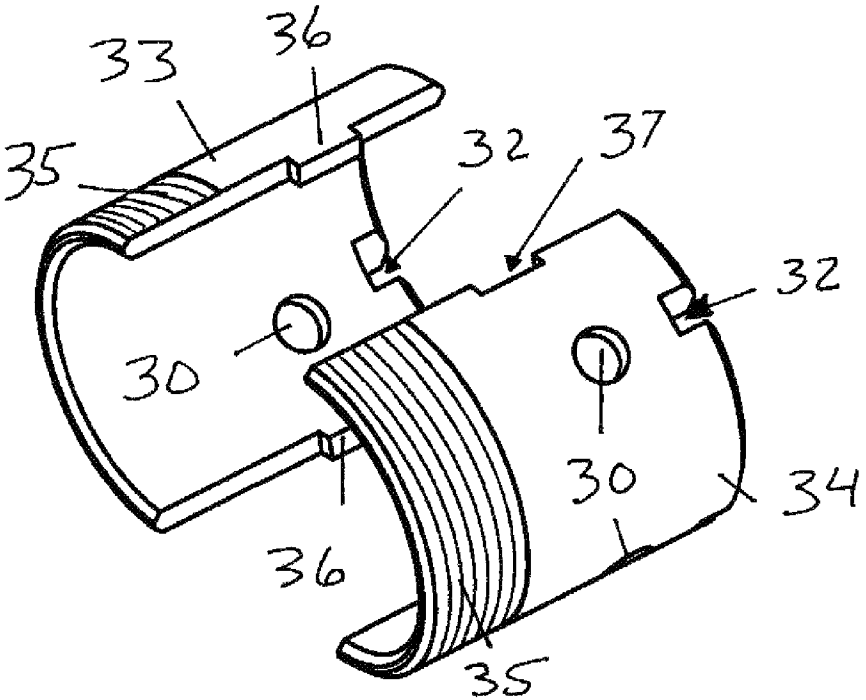
FIG. 24 is a perspective view of the two-piece separable extension of the inner barrel nut of the second preferred embodiment of the present invention, and further showing external threads used for connection to the receiver portion of the inner barrel nut extension shown in FIGS. 20-23.

FIGS. 20-24 show the configuration of inner barrel nut 5' in second preferred embodiment 26 which is separable into three pieces to facilitate the removal of a rifle's barrel 44 once top hand guard element 2' and bottom hand guard element 3 are removed from around barrel 44. Inner barrel nut 5 comprises a ring-shaped receiver portion 31 and two easily separable extension pieces 33 and 34 which when secured by threaded connection to receiver portion 31 create a generally tubular extension of receiver portion 31. FIG. 20 is a perspective view of the left side of the assembled inner barrel nut 5' showing its receiver end 49 and its circumferential recess 48, two-piece separable extension 33/34, side openings 29 and 30 used for tool engagement during installation/removal of inner barrel nut 5' in its fixed connection to rifle receiver 45, forward indentations 32 that assist in connection of extension 33/34 to ring-shaped receiver portion 31, and internal threads 35 used for connection of inner barrel nut 5' to receiving threads (not shown) on rifle receiver 45. A threaded connection between inner barrel nut 5' and rifle receiver 45 is preferred, but not critical, and it is also considered to be within the scope of the present invention for the threads 35 shown in FIGS. 20, 22, and 23 to be replaced by other structure complementary to that in upper rifle receiver 45 to provide a secure connection between the receiver end 49 of inner barrel nut 5' and upper rifle receiver 45. FIG. 21 is a perspective view of assembled inner barrel nut 5' from its barrel end and showing component configuration similar to that in FIG. 20. As stated hereinabove, a rifle barrel 44 extends through inner barrel nut 5' without any contact or connection between barrel 44 and inner barrel nut 5', with each independently connected to rifle receiver 45. FIGS. 22 and 23 are perspective views of the ring-shaped receiver portion 31 of inner barrel nut 5' and showing internal threads 35 on each of its ends, with threads 35 on its barrel end used for connection of receiver portion 31 to the two-piece inner barrel nut extension 33/34 shown in FIGS. 20, 21, and 24. The other set of internal threads 35 on receiver portion 31 are used for connection of inner barrel nut 5' to receiving threads (not shown) on rifle receiver 45, and receiver portion 31 may remain attached to receiver 45 while barrel 44 is easily removed from receiver 45 for inspection and/or cleaning. The openings 29 in the receiver portion 31 of inner barrel nut 5' shown in FIGS. 22 and 23 allow use of a tool for installation/removal of inner barrel nut 5' from receiver 45. FIG. 24 is a perspective view of the two-piece separable extension 33/34 of inner barrel nut 5' in second preferred embodiment 26, and further shows the external threads 35 on one end thereof that are used for connection of two-piece extension 33/34 to the receiver portion 31 of inner barrel nut 5'. FIG. 24 also shows several openings 30 in extension 33/34 and forward indentations 32, which can serve the same tool-related installation/removal purpose for connecting extension 33/34 to receiver portion 31. Although FIG. 24 shows extension member 33 having two side tabs 36 used for engagement of side recesses 37 (one hidden) in extension member 34, the reverse positioning of tabs 36 and recesses 37 could occur. Also, extension members 33 and 34 could each have one tab 36 and one recess 37 configured and oriented for mated connection. In addition, while the tabs 36 and recesses in FIG. 24 are most preferred, the size, number, configuration, and positioning of tabs 36 and recesses 37 on the sides of extension members 33 and 34 are not critical. The size, number, configuration, and positioning of openings 29 and 30 and the forward indentations 32 in inner barrel nut 5' are also not considered critical and one should not envision them as being limited to the examples illustrated in FIG. 24.

Figure 25:
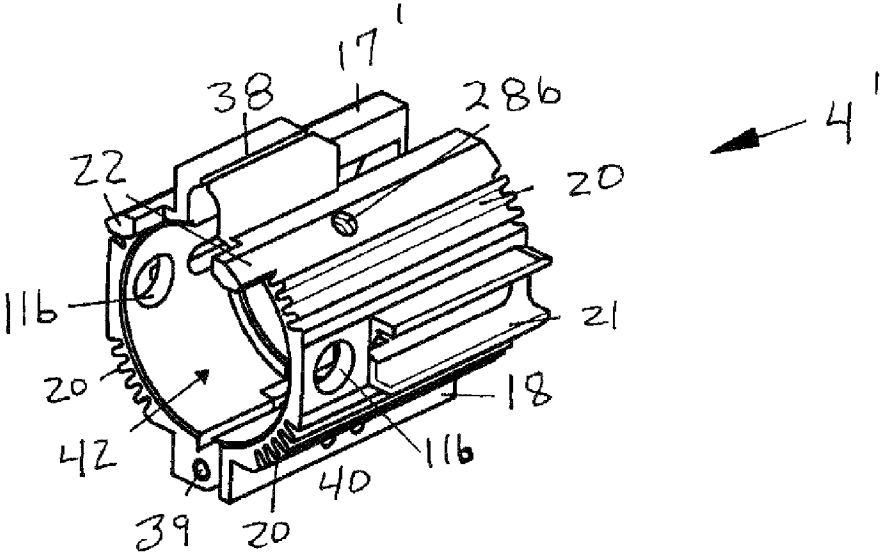
FIG. 25 is a perspective view of the left side of the hinged outer barrel nut in the second preferred embodiment of the present invention, showing one of its laterally-extending side lugs, tabs on its left end used for receiver connection, two opposed non-threaded holes aligned with the sling swivel recesses having rotation limiters and threads that are located on the receiver end of the top hand guard element and which are used for insertion of the spring-loaded detent screw to allow engagement of its tip with the outer surface of the inner barrel nut, radially-extending baffles used for heat dissipation, a split top stabilizing member that engages structure in the top hand guard element to prevent side-to-side movement of the top hand guard element, a bottom stabilizing member that engages structure in the bottom hand guard element to prevent side-to-side movement of the bottom hand guard element, a clamshell action adjustment hole, and openings laterally through the bottom stabilizing member used for fixing the hinge between the two halves of the outer barrel nut.
Figure 26:
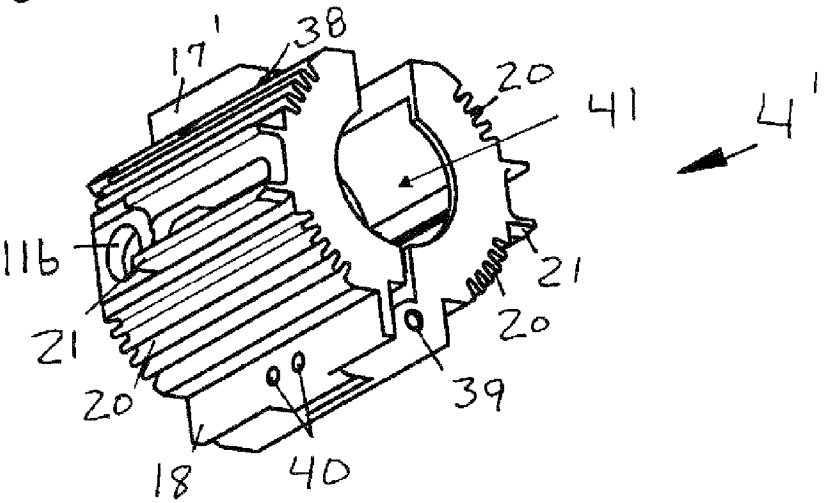
FIG. 26 is a perspective view of the right side of the hinged outer barrel nut in the second preferred embodiment of the present invention, showing similar construction to that shown in FIG. 25, with additional detailed revealed about its hinged connection.
Figure 27:
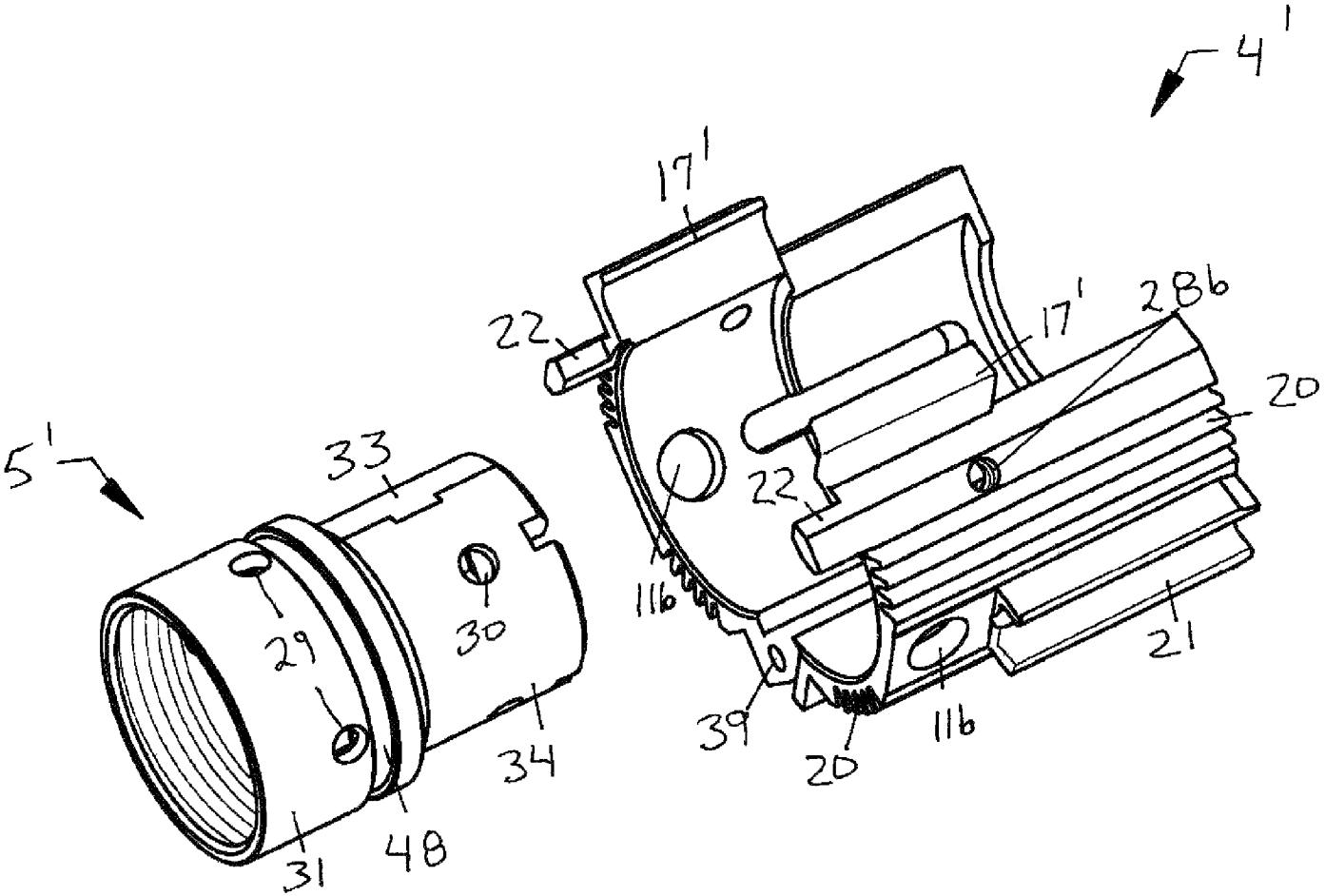
FIG. 27 is a perspective view of the inner and outer barrel nuts in the second preferred embodiment of the present invention, with the inner barrel nut positioned to the left of the outer barrel nut, which is shown in a opened configuration.

FIGS. 25-27 show enlarged views of the hinged outer barrel nut 4' used as a part of the second preferred embodiment 26 of the present invention. FIGS. 25 and 26 show outer barrel nut 4' in a closed (or nearly closed) configuration, while FIG. 27 shows outer barrel nut 4' in an opened configuration and ready for positioning around inner barrel nut 5'. FIG. 25 is a perspective view of the left side of hinged outer barrel nut 4' showing one of its laterally-extending side lugs 21 (the opposed side lug 21 is hidden), spaced-apart tabs 22 on its left-facing (receiver) end 42 used for receiver 45 engagement, two opposed non-threaded holes **11*b* that become aligned with the sling swivel recesses 11 (each having rotation limiters and threads) on the receiver end of the top hand guard element 2 and which are used for insertion of a spring-loaded detent screw 6 so that its tip 25 can become engaged with the outer surface of inner barrel nut 5', radially-extending baffles 20 used for heat dissipation, a split top 38 stabilizing member 17' that engages structure in the top interior surface of top hand guard element 2' to prevent side-to-side movement of top hand guard element 2' during use, a bottom stabilizing member 18 that engages structure in the bottom interior surface of bottom hand guard element 3 to prevent side-to-side movement of the bottom hand guard element 3 during use, a threaded clamshell action adjustment hole 28*b* in the top portion of outer barrel nut 4' used to receive an adjustment screw (not shown), and openings 40 laterally through the bottom stabilizing member 18 and used for fixing the hinge 39 between the two halves of outer barrel nut 4'. FIG. 26 is a perspective view of the right side of the hinged outer barrel nut 4' showing its barrel end 41 and similar construction to that shown in FIG. 25, with a little more detailed revealed about the preferred but not critical configuration of hinged connection 39. FIG. 27 is a perspective view of inner barrel nut 5' and outer barrel nut 4' positioned adjacent to one another and in an orientation with receiver ends thereof (respectively 49 and 42) pointing in the same direction (to the viewer's left). In FIG. 27 outer barrel nut 4' has open positioning that shows no internal threads or other connecting structure used to secure outer barrel nut 4' to inner barrel nut 5'** (instead set screws or an adjustment screw are contemplated to prevent rotation of one with respect to the other).

Figure 28:
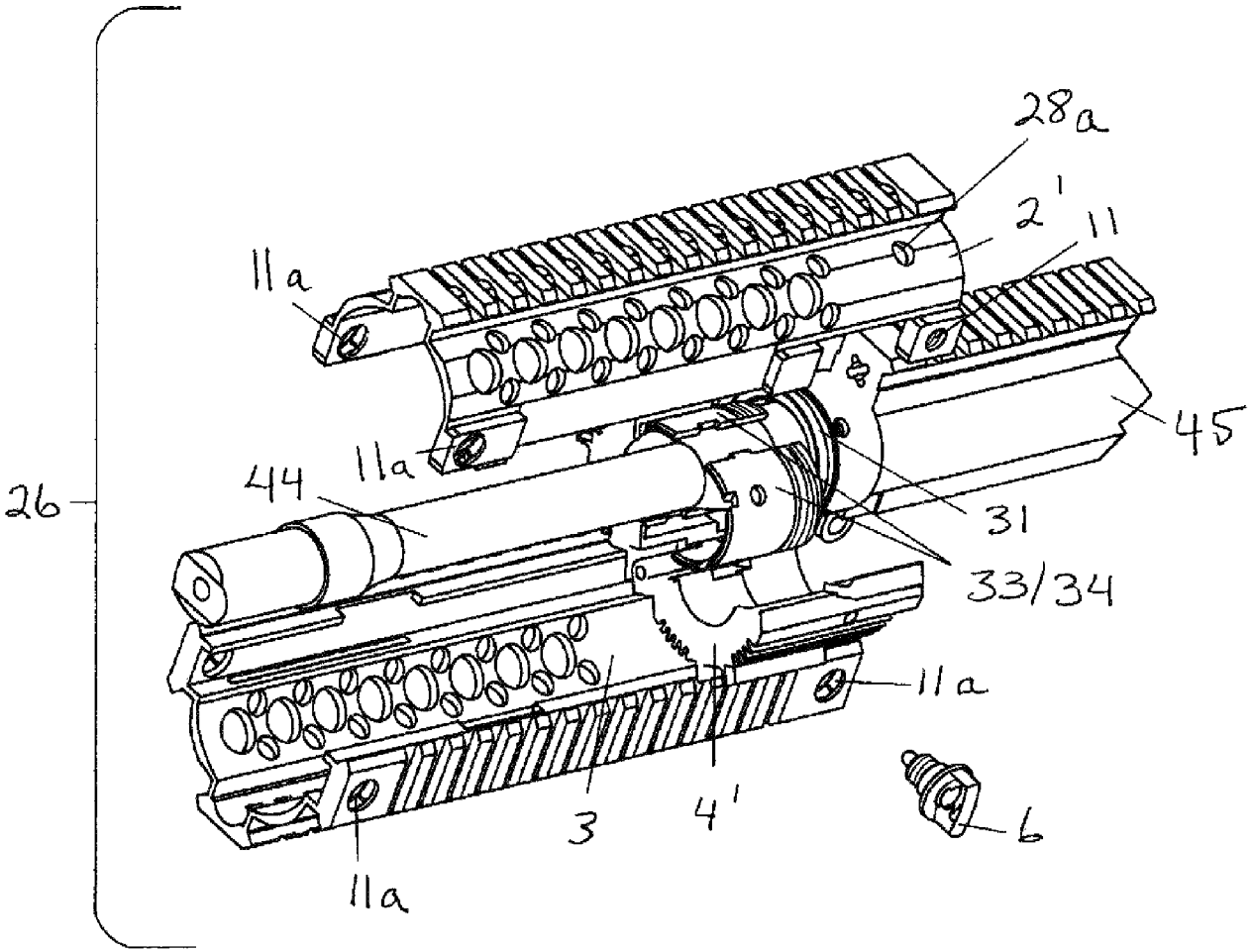
FIG. 28 is an exploded view of the second preferred embodiment of the present invention ready for installation to the receiver of a rifle and positioning around the rifle's barrel.

FIG. 28 is an exploded view of the second preferred embodiment 26 of the present invention ready for installation to the receiver 45 of a rifle wherein cantilevered positioning of its top and bottom hand guard elements (respectively 2' and 3) is achieved around the rifle's barrel 44. Installation of preferred embodiments of the present invention, including first and second preferred embodiments 1 and 26, generally includes the following steps. The rear portion of inner barrel nut 5 or 5' is threaded onto the male threads (not shown) of the front portion of receiver 45 (or otherwise affixed by the particular attachment provisions of a different design receiver) so that inner barrel nut 5 or 5' has fixed positioning with receiver 45 and the rifle's barrel 44 extends through the tubular interior of inner barrel nut 5 or 5' with a connection to receiver 45 that is independent from that of inner barrel nut 5 or 5'. A spanner wrench (not shown) may be used to engage slot 50 in inner barrel nut 5 or openings 29 or 30 in inner barrel nut 5' to securely torque inner barrel nut 5 or 5' onto receiver 45. Forward indentations 32 on the extensions 33/34 of inner barrel nut 5' assist in the connection of extensions 33/34 to the ring-shaped and internally-threaded portion of inner barrel nut 5'. Outer barrel nut 4 is then telescopically received over and longitudinally secured to inner barrel nut 5 so that outer barrel nut 4 is non-rotatable with respect to inner barrel nut 5. In the alternative, outer barrel nut 4' is received over inner barrel nut 5' as a result of its hinged clamshell closing action and then made non-rotatable with respect to inner barrel nut 5' via an adjustable set screw inserted and tightened in a threaded hole 28*a* through outer barrel nut 4'. The present invention's top hand guard element 2 or 2' is then engaged with, and extends forwardly from, outer barrel nut 4 or 4' in a laterally-stable cantilevered fashion. Lugs 21 on the left and right sides of outer barrel nut 4 or 4' allow top hand guard element 2 or 2' to slide on outer barrel nut 4 or 4' and around opposed lugs 21 with a downward push. Bottom hand guard element 3 is then free-floated from top hand guard element 2 or 2' by aligning features (various lugs and recesses mentioned hereinabove) on top and bottom hand guard elements, and then pushing up bottom hand guard element 3 so that it slides in a backward motion that locks both top and bottom hand guard elements (2 or 2', and 3) together so that their receiver ends become positioned around outer barrel nut 4 or 4'. The spring-loaded detent screw 6 shown in FIG. 28 is also inserted through one of the sling swivel recesses 11*a* (having rotation limiters and no threads) located on the receiver end of bottom hand guard element 3 and secured into one of the sling swivel recesses 11 (having rotation limiters and threads) located on the same side of the receiver end of top hand guard element 2' to tightly secure top and bottom hand guard elements 2' and 3 together, and at the same time put pressure on both sides of the present invention hand guard (2' and 3) due to the fact that the tip 25 of the spring-loaded detent screw 6 is against the inner barrel nut 5' pushing away from the opposite side thereof.

Since many modifications, variations, and changes in non-patentably distinct detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A quick-detach and free-floating forward hand guard assembly for a rifle having a receiver and a barrel supported by the receiver, said hand guard assembly comprising:

a generally tubular inner barrel nut having an outer surface, a rearward end, and a forward end;

an outer barrel nut received over said inner barrel nut and secured thereto for non-rotation of said outer barrel nut with respect to said inner barrel nut, said outer barrel nut having a receiver end, spaced-apart tabs on said receiver end, and an opposed barrel end, said receiver end of said outer barrel nut surrounding said rearward end of said inner barrel nut and said opposed barrel end of said outer barrel nut surrounding said forward end of said inner barrel nut, said outer barrel nut further comprising a top stabilizing member, a bottom stabilizing member, two laterally-extending side lugs in opposed positioning from one another, and opposed holes through said receiver end of said outer barrel nut in positions placing one of said holes adjacent to a different one of said laterally-extending side lugs;

a top hand guard element having a receiver end engaged with said receiver end of said outer barrel nut and a barrel end extending forwardly beyond said barrel end of said outer barrel nut, said top hand guard element also having opposed upper recesses that receive said laterally-extending side lugs of said outer barrel nut after said top hand guard element is pushed downwardly toward said top stabilizing member and is caused to slide around said side lugs, said top hand guard element also having two laterally-opposed downward lugs on said barrel end, said top hand guard element further having top interior receiving structure in receipt of said top stabilizing member of said outer barrel nut, said top interior receiving structure closely aligned with said top stabilizing member of said outer barrel nut and reducing movement of said top hand guard element relative to said outer barrel nut, said top hand guard element further comprising at least one internally-threaded sling swivel recess;

a bottom hand guard element having a receiver end engaged associated with said receiver end of said upper hand guard element and a barrel end associated with said barrel end of said top hand guard element, said bottom hand guard element matingly engaged with said top hand guard element and having two elongated side channels each laterally-opposed from one another, said side channels each receiving a different one of said laterally-opposed downward lugs on said top hand guard element, each said side channel also having a barrel end and a receiver end, said bottom hand guard element further comprising opposed lateral recesses each positioned above said barrel end of a different one of said side channels allowing said top and bottom hand guard elements to become locked together with said receiver ends respectively thereof becoming positioned around said outer barrel nut as said bottom hand guard element is pushed upward toward said top hand guard element and slides in a rearward motion toward said outer barrel nut, said bottom hand guard element also having bottom interior receiving structure in receipt of said bottom stabilizing member of said outer barrel nut, said bottom interior receiving structure closely aligned with said bottom stabilizing member and reducing movement of said bottom hand guard element relative to said outer barrel nut when said top hand guard element and said bottom hand guard element are matingly engaged and said bottom hand guard element is free-floating from said top hand guard element, said bottom hand guard element further comprising a plurality of non-threaded sling swivel recesses; and at least one quick-detach spring-loaded screw inserted through one of said non-threaded sling swivel recesses on said receiver end of said bottom hand guard element and tightened within one of said threaded sling swivel recesses on said receiver end of said top hand guard element until said screw also becomes inserted through one of said holes in said outer barrel nut and applies pressure against said outer surface of said inner barrel nut, wherein when said rearward end of said inner barrel nut is connected to a front portion of the rifle receiver and said tabs on said receiver end of said outer barrel nut independently engage the front portion of the rifle receiver, said forward end of said inner barrel nut becomes positioned over and around the rifle barrel without contacting the barrel, said top hand guard element as it engages said outer barrel nut becomes cantilevered over and free-floating above the rifle barrel, and said bottom hand guard element when connected to said top hand guard element becomes positioned under the rifle barrel with said spring-loaded screw inserted through one of said holes on said receiver end of said outer barrel nut and aligned ones of said sling swivel recesses on said receiver ends of said top and bottom hand guard elements, whereafter tightening said screw to apply pressure against said outer surface of said inner barrel nut allows said top and bottom hand guard elements joined around the rifle barrel to have laterally-stable positioning around the barrel without up-and-down or side-to-side movement relative to the barrel, no contact with the barrel, quick-detachment to expose the barrel, and no interference with rifle operation and accuracy.

2. The hand guard assembly according to claim 1 wherein said rearward end of said inner barrel nut comprises female threads providing a secure connection between said inner barrel nut and the rifle receiver.

3. The hand guard assembly according to claim 1 wherein said inner barrel nut further comprises at least one opening therethrough allowing tool-assisted tightening of said inner barrel nut to the rifle receiver.

4. The hand guard assembly according to claim 1 wherein said inner barrel nut further comprises a two-piece separable extension.

5. The hand guard assembly according to claim 4 wherein said bottom stabilizing member of said outer barrel nut further comprises a bottom hinge and said top stabilizing member further comprises a split, said hinge and said split together allowing said outer barrel nut to achieve clamshell closing action around said inner barrel nut, said two-piece separable extension and said clamshell closing action facilitating rapid barrel access and detachment.

6. The hand guard assembly according to claim 5 wherein said top hand guard element further has a tool access opening therethrough and said outer barrel nut has a threaded receiving hole for a fastener, said tool access opening and said threaded receiving hole aligned with one another so as to allow insertion of a tool through said access opening and engagement of the tool with a fastener tightened in said threaded receiving hole for adjustment of said clamshell closing action for secure engagement of said outer barrel nut around said inner barrel nut.

7. The hand guard assembly according to claim 1 wherein said inner barrel nut further comprises an outer surface and at least one circumferential recess in said outer surface, and engagement of said quick-detach spring-loaded screw with inner barrel nut occurring within said at least one circumferential recess to provide fixed positioning of said outer barrel nut against said inner barrel nut.

8. The hand guard assembly according to claim 4 wherein said two-piece separable extension has a barrel end and connection-assisting structure allowing insertion of a tool that is selected from a group consisting of holes through said two-piece separable extension and notches in said barrel end of said two-piece separable extension.

9. The hand guard assembly according to claim 4 wherein said rearward end of said inner barrel nut further comprises a ring-shaped receiver portion, and said two-piece separable extension has a threaded connection with said ring-shaped receiver portion.

10. The hand guard assembly according to claim 4 wherein said at least one quick-detach spring-loaded screw is a detent screw with an easily hand-manipulated handle portion.

11. The hand guard assembly according to claim 1 wherein said outer barrel nut further comprises at least one heat-dissipating baffle.

12. The hand guard assembly according to claim 11 wherein said at least one heat-dissipating baffle has a radially-extending configuration.

13. The hand guard assembly according to claim 1 further comprising at least one heat venting hole selected from a group consisting of heat venting holes through said top hand guard element and heat venting holes through said bottom hand guard element.

14. The hand guard assembly according to claim 1 further comprising at least one accessory mounting rail axially aligned with said top and bottom hand guard elements.

15. The hand guard assembly according to claim 14 having four said accessory mounting rails defining a quad rail construction, and wherein one said accessory mounting rail is associated with said top hand guard element and wherein three of said accessory mounting rails are associated with said bottom hand guard element.

16. The hand guard assembly according to claim 15 wherein said quad rail construction comprises four accessory mounting rails substantially equally spaced about a perimeter of said combined top and bottom hand guard elements, each conforming to MIL-STD-1913.

17. The hand guard assembly according to claim 1 further comprising:

said rearward end of said inner barrel nut having female threads providing a secure connection between said inner barrel nut and the rifle receiver;

said inner barrel nut further having at least one opening therethrough allowing tool-assisted tightening of said inner barrel nut to the rifle receiver, and also having at least one circumferential recess in said outer surface providing engagement of said quick-detach spring-loaded screw with inner barrel nut and further providing fixed positioning of said outer barrel nut against said inner barrel nut;

said at least one quick-detach spring-loaded screw is configured as a detent screw with an easily hand-manipulated handle;

said outer barrel nut further having at least one heat-dissipating baffle with a radially-extending configuration;

a plurality of heat venting holes through said top hand guard element and through said bottom hand guard element; and four accessory mounting rails axially aligned with said top and bottom hand guard elements and defining a quad rail construction, with one of said accessory mounting rails associated with said top hand guard element and three of said accessory mounting rails associated with said bottom hand guard element, said four accessory mounting rails substantially equally spaced apart from one another.

18. The hand guard assembly according to claim 17 wherein said bottom stabilizing member of said outer barrel nut further comprises at least one fastener hole therethrough in communication with said inner barrel nut, wherein a fastener tightened in each said at least one fastener hole provides fixed positioning of said outer barrel nut to said inner barrel nut.

19. The hand guard assembly according to claim 1 further comprising:

said rearward end of said inner barrel nut having female threads providing a secure connection between said inner barrel nut and the rifle receiver;

said inner barrel nut further having at least one opening therethrough allowing tool-assisted tightening of said inner barrel nut to the rifle receiver, and also having at least one circumferential recess in said outer surface providing engagement of said quick-detach spring-loaded screw with inner barrel nut and further providing fixed positioning of said outer barrel nut against said inner barrel nut;

said inner barrel nut further having a two-piece separable extension and a ring-shaped receiver portion with a threaded connection therebetween, said bottom stabilizing member of said outer barrel nut further comprises a bottom hinge and said top stabilizing member further comprises a split, said hinge and said split together allowing said outer barrel nut to achieve clamshell closing action around said inner barrel nut, said two-piece separable extension and said clamshell closing action facilitating rapid barrel access and detachment;

said at least one quick-detach spring-loaded screw configured as a detent screw with an easily hand-manipulated handle;

said outer barrel nut further having at least one heat-dissipating baffle with a radially-extending configuration;

a plurality of heat venting holes through said top hand guard element and through said bottom hand guard element; and four accessory mounting rails axially aligned with said top and bottom hand guard elements and defining a quad rail construction, with one of said accessory mounting rails associated with said top hand guard element and three of said accessory mounting rails associated with said bottom hand guard element, said four accessory mounting rails substantially equally spaced apart from one another.

20. The hand guard assembly according to claim 19 wherein said top hand guard element further has a tool access opening therethrough and said outer barrel nut has a threaded receiving hole for a fastener, said tool access opening and said threaded receiving hole aligned with one another so as to allow insertion of a tool through said access opening and engagement of the tool with a fastener tightened in said threaded receiving hole for adjustment of said clamshell closing action for secure engagement of said outer barrel nut around said inner barrel nut.

* * * * *